US005808647A

United States Patent [19]

Kurata et al.

[11] Patent Number: 5,808,647

[45] Date of Patent: Sep. 15, 1998

[54] SHEET CONVEYING APPARATUS HAVING A RELEASABLE PRESS MEMBER FOR APPLYING PRESSURE TO A SHEET

[75] Inventors: Mitsuru Kurata, Kawasaki; Shigeyoshi Onoda, Yokohama, both of Japan

[73] Assignee: Canon Kabushiki Kaisha, Tokyo, Japan

[21] Appl. No.: 948,322

[22] Filed: Oct. 10, 1997

Related U.S. Application Data

[63] Continuation of Ser. No. 406,803, Mar. 20, 1995, abandoned, which is a continuation of Ser. No. 937,314, Aug. 31, 1992, abandoned.

[30] Foreign Application Priority Data

| | | | |
|---|---|---|---|
| Sep. 3, 1991 | [JP] | Japan | 3-222876 |
| Jan. 7, 1992 | [JP] | Japan | 4-018486 |
| Jan. 10, 1992 | [JP] | Japan | 4-022099 |

[51] Int. Cl.[6] ..... B41J 2/01; B41J 13/10

[52] U.S. Cl. ..... 347/104; 400/624; 400/645

[58] Field of Search ..... 346/134; 347/8, 347/104, 105; 400/55–57, 48, 624, 645

[56] References Cited

U.S. PATENT DOCUMENTS

| | | | |
|---|---|---|---|
| 4,233,895 | 11/1980 | Wehler | 101/93.05 |
| 4,617,580 | 10/1986 | Miyakawa | 346/134 |
| 4,620,807 | 11/1986 | Polit | 400/56 |
| 4,764,777 | 8/1988 | Saito et al. | 347/67 |
| 5,132,702 | 7/1992 | Shiozaki et al. | 347/12 |
| 5,170,184 | 12/1992 | Hanabusa et al. | 346/134 |
| 5,177,547 | 1/1993 | Kanemitsu et al. | 347/104 |

FOREIGN PATENT DOCUMENTS

| | | |
|---|---|---|
| 281499 | 1/1988 | European Pat. Off. . |
| 472218 | 2/1992 | European Pat. Off. . |
| 2749004 | 5/1979 | Germany . |
| 3210213 | 9/1983 | Germany . |
| 57-84885 | 5/1982 | Japan . |
| 63-41165 | 2/1988 | Japan . |

*Primary Examiner*—N. Le
*Assistant Examiner*—Craig A. Hallacher
*Attorney, Agent, or Firm*—Fitzpatrick, Cella, Harper & Scinto

[57] ABSTRACT

The present invention provides a sheet conveying apparatus comprising a sheet supply device which supplies a sheet, a guide member which guides the sheet delivered by the sheet supplying device, a hold down member which presses the sheet against the guide member, a release device which releases the pressure of the hold down member, and a control device which controls the sheet supply device in connection with pressure releasing operation of the release device.

11 Claims, 19 Drawing Sheets

SHEET CONVEYING APPARATUS HAVING A RELEASABLE PRESS MEMBER FOR APPLYING PRESSURE TO A SHEET

This application is a continuation of application Ser. No. 08/406,803, filed Mar. 20, 1995, now abandoned, which is a continuation of application Ser. No. 07/937,314, filed Aug. 31, 1992, now abandoned.

BACKGROUND OF THE INVENTION

1. Field of the Invention

The present invention relates to a sheet conveying apparatus having sheet hold down means for preventing a sheet from floating, and a recording apparatus for recording onto a recording sheet with recording means.

2. Related Background Art

Conventionally, a recording apparatus of the serial recording records one line by scanning with a carriage, and then conveys a recording sheet by the necessary amount to record the next line. Exemplary of such recording apparatus is an ink jet printer or an impact printer, in which the improvement of recording quality has been attempted by making the distance between recording sheet and recording head as close as possible. However, if any floating or slack occurs at a recording position on the recording sheet, the recording sheet and the recording head may be rubbed so that the sheet is stained.

Thus, as shown in FIG. 25, recording sheet 5 was prevented from floating by applying sheet hold down members 7*a*, 7*b* to hold down the recording sheet 5 along a passage of the recording head 6 with the action of roller-like pressers 9*a*, 9*b* placed under gravity of the carriage 8. 5 is a platen plate, and 4*a*, 4*b*, 4*c* and 4*d* are conveying rollers. Sheet hold down members 7*a* and 7*b* are swingably engaged with the rotational axis of conveying roller 4*b* and conveying roller 4*d*, respectively. Herein, to avoid to obstruct the sheet conveyance, except for the scanning with the carriage, the sheet hold down members 7*a* and 7*b* are turned upward and retracted with the biasing force by a plate spring 14 and a torsion spring 16, respectively.

However, when a thin plate-like member having a low rigidity, for example, was used as the sheet hold down member as above constituted, there was a danger that recording heads 6*a*, 6*b*, 6*c*, 6*d* might be damaged because the sheet hold down member 7*a* is always biased by pressure member 14, and thus may be deformed due to a biasing force P of the plate spring 14 during the scanning of the carriage, thereby causing an edge portion of the sheet hold down member to make contact with any of recording heads 6*a*, 6*b*, 6*c*, 6*d*, as shown in FIG. 24. In particular, when a plurality of heads were mounted on the carriage as shown in FIG. 26, the carriage was constructed to be longer in a scanning direction, so that such a contact was easily caused due to the deformation of the hold down members.

Also, in a recording sheet hold down mechanism of a conventional recording apparatus, when there was any positional error in the pressing member for pressing a recording sheet hold down member due to misalignment on the manufacture, the recording sheet hold down member could not be pressed uniformly and with a proper force, and was thus moved (e.g., rotated) as if it was dragged due to a frictional force with the recording sheet to be conveyed, so that the top portion of the recording sheet hold down member might make contact with the recording heads in some cases, thereby damaging the recording heads.

An example of such a conventional recording apparatus is shown in FIGS. 27 and 28. In the same figure, a pair of conveying rollers 101 upstream of a platen 103, and a pair of conveying rollers 102 downstream thereof are disposed to convey the recording sheet P in a direction of arrow 105. The recording sheet P being conveyed is printed and recorded with a predetermined image by the serial scan of recording means (not shown) disposed upward of the platen 103.

Means for detecting a trailing edge of the sheet member P is a sensing end 107*a* of a paper detection sensor arm 107 disposed near the pair of conveying rollers 101, or on an axial line of the pair of conveying rollers 101 in this invention, wherein the sensor lever 107 fitted around a support axis 106 is biased in a clockwise direction by a tension spring 109. The trailing edge of the sheet member P can be detected by a sensor 110 because the sensor lever 107 is disengaged therefrom when the trailing edge of the sheet member P exits from the pair of conveying rollers 101, as shown in FIG. 28.

This method is effective when the operation of an apparatus starts with the action of the sensor arm 107 since the presence or absence of the sheet member P at a nip of the pair of conveying rollers 101 can be detected. For example, when this is used as a start signal for the manual sheet supply, the sheet can be conveyed smoothly because if the sensor arm 107 is activated from a leading edge of paper, the leading edge of paper has reached the nip portion at the same time.

However, in the above conventional example, there was a drawback that if the edge of sheet was attempted to detect, correct detection might not be made because it was affected by a curl state of the sheet member P. That is, though a sheet member P having no deformation is shown as shown in FIG. 27, if a sheet member P having its edge curled upwardly is passed through, the sheet detection sensor arm 107 will be raised up earlier than for the normal sheet member P, as shown in FIG. 28, while if a sheet member P having its edge curled downwardly is passed through, the return of sheet detection sensor arm 107 will be retarded. Thereby, in an apparatus having set a predetermined margin for the trailing edge, the amount of conveying the sheet member P may be varied, resulting in a great dispersion on the margin. In remarkable cases, the margin of sheet member P may disappear, causing the print to be made on the platen 103, whereby there is an inconvenience that a back surface may be contaminated at the next printing.

SUMMARY OF THE INVENTION

An object of the present invention is to simplify the constitution of an apparatus by preventing the deformation of pressing member for pressing a sheet against guide means.

Also, another object of the invention is to provide a recording apparatus which can eliminate the contact between a recording sheet hold down member and a recording head because at least a top portion of said recording sheet hold down member can be brought into close contact with a recording sheet even if there is any positional error in pressing member for pressing said recording sheet hold down member owing to misalignment on the manufacture.

A further object of the invention is to provide a recording apparatus which can make the recording onto a sheet member even in a curled state having a disturbed margin by pressing a trailing edge of the sheet member against a platen.

DETAILED DESCRIPTION OF PREFERRED EMBODIMENT

A preferred embodiment of a recording apparatus to which the present invention is applied in an ink jet recording method will be described below.

Figure 1:
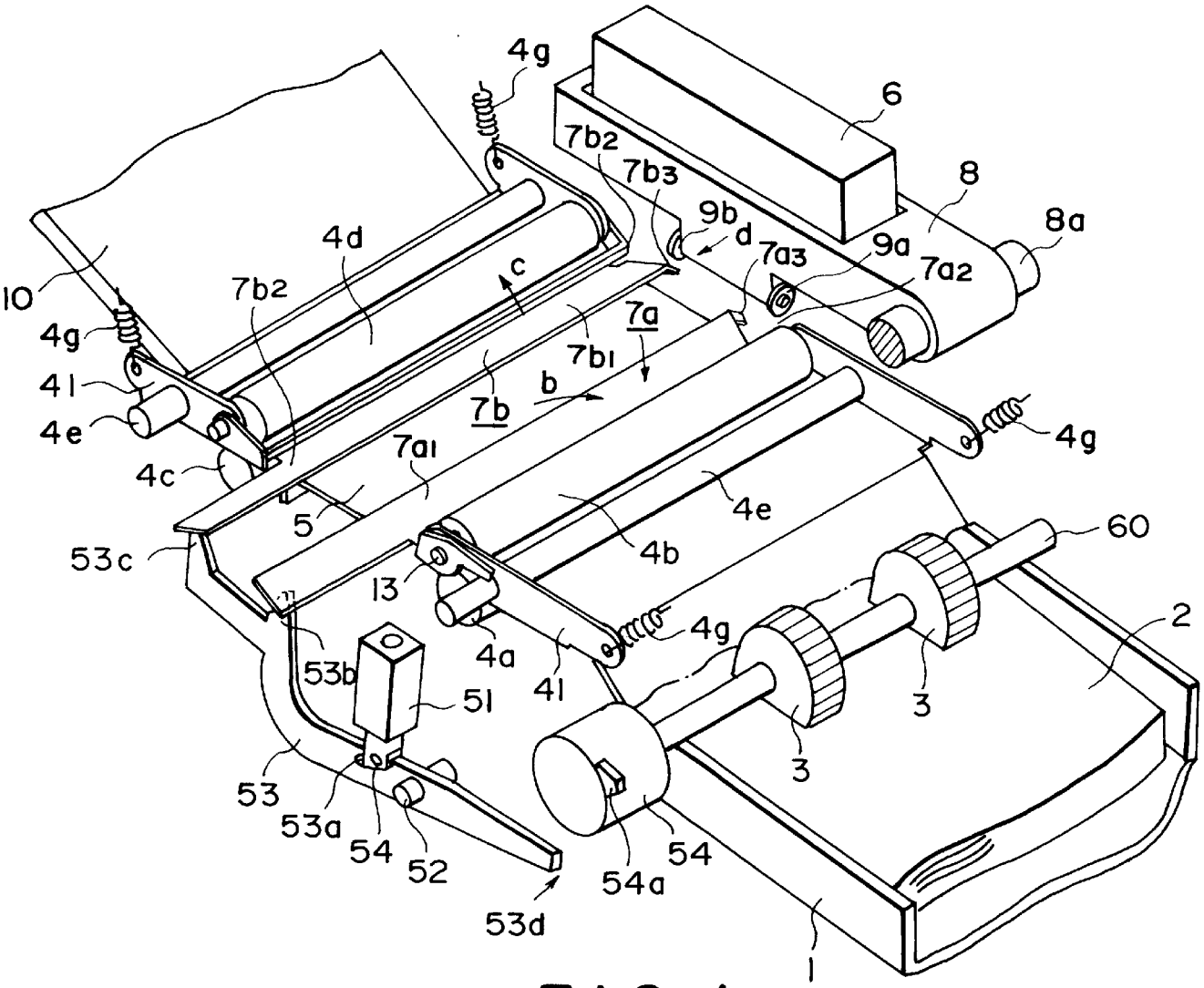
FIG. 1 is a perspective view of an embodiment of this invention.

This recording apparatus is configured in such a manner as to supply recording sheets 2 stacked within a cassette 1, one by one, with pickup rollers 3, convey a recording sheet with sheet conveying means 4, and drive a recording head 6 serving as recording means to perform the recording onto the recording sheet 2 held on a platen 5 with its back surface, as shown in FIG. 1, wherein the recording sheet 2 is prevented from floating by sheet hold down members 7 during the recording. The sheet hold down member 7 is configured to hold down the recording sheet 2 with pressing rollers 9 attached on a carriage 8 when the carriage 8 is moved in recording.

In the following, the constitution of each part will be specifically described below.

(Sheet Conveying Means)

Sheet conveying means 4 comprises a conveying roller 4*a* and a pinch roller 4*b* for conveying the recording sheet 2 to a recording area, and an exhaust roller 4*c* and a pinch roller 4*d* for exhausting recorded sheet 2 to an exhaust tray 10, as shown in FIG. 1. The conveying roller 4*a* and the exhaust roller 4*c* are connected to conveying motor (not shown) and driven rotatably. The pinch rollers 4*b*, 4*d* are mounted to one end portions of arms 4*f* rotatable around shafts 4*e*, respectively, and compressed against the conveying roller 4*a* and the exhaust roller 4*c* by tension springs 4*g* attached at other end portions of the arms 4*f*, respectively. Thereby, the recording sheet 2 is conveyed in a direction of arrow a of FIG. 1, if it is driven by the conveying motor.

Note that a driving force is transmitted so that the exhaust roller 4*c* is rotated at a rotational peripheral speed faster several percent than that of the conveying roller 4*a*, so that an adequate tension is applied to the recording sheet to be conveyed.

(Recording Means)

Recording means records an ink image onto a recording sheet conveyed by conveying means in the ink jet recording method.

In the ink jet recording method, there are provided with liquid discharge openings or orifices for discharging and jetting the recording ink as fine liquid droplets, liquid channels communicating to respective discharge orifices, and discharge energy generating means provided on the way of liquid channel for supplying the discharge energy to discharge the ink liquid within the liquid channel. The discharge energy generating means is driven in accordance with a drive signal to discharge ink droplets to record an image.

Examples of the discharge energy generating means include pressure energy generating means of electromechanical converter such as a piezoelectric element, electromagnetic energy generating means for generating the electromagnetic wave such as a laser to irradiate and heat the ink liquid to discharge ink droplets with the action of generated heat, and heat energy generating means for heating the ink liquid with electricity-heat converters to discharge the ink. Among them, a method of discharging the ink by using heat energy generating means based on electricity-heat converters is preferable because it allows the recording at high resolutions owing to liquid discharge orifices arranged at high densities, while allowing the compactization of recording head.

This embodiment uses a bubble jet recording method proposed by CANON INC. among the ink jet recording methods for the recording means.

Figure 2:
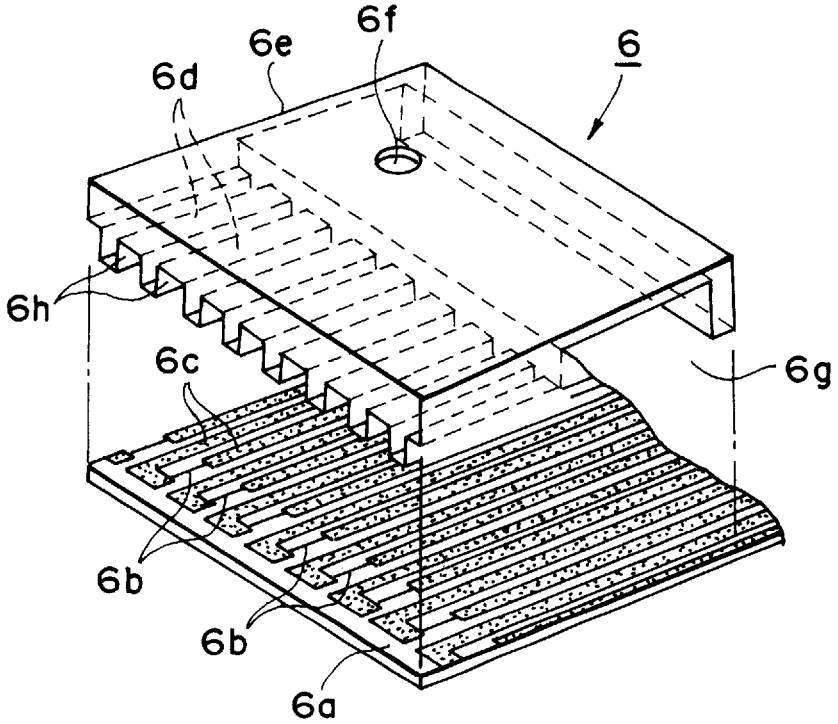
FIG. 2 is a configurational explanation view of a recording head.

FIG. 2 is a separated construction view of the recording head 6, and FIGS. 3 to 9 are explanation views of the bubble jet recording.

In FIG. 2, 6*a* is a heater board disposed on a silicon substrate, having electricity-heat converters (discharge heaters) 6*b* and electrodes 6*c* made of aluminum for supplying the power which are formed as the film. A ceiling plate 6*e* having partition walls for partitioning liquid channels (nozzles) containing the recording liquid is bonded to the heater board 6*a*. An ink cartridge for supplying the ink to the recording head 6 is loaded exchangeably at a predetermined position of this apparatus. The ink supplied via a conduit from the ink cartridge is filled through a supply port 6*f* provided on the ceiling plate 6*e* into a common liquid chamber 6*g* within the recording head 6 and thereafter led to nozzles 6*d*. Each nozzle 6*d* is formed with an ink discharge orifice 6*h*, which is turned downward opposed to the recording sheet 2 at a predetermined pitch in a sheet conveying direction.

In this embodiment, the recording head 6 thus constituted is mounted on the carriage movable reciprocatingly to make the recording by discharging fine ink droplets from the recording head 6 in synchronism with the movement of the carriage.

As to representative principle of discharging ink droplets in the bubble jet recording method, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

Figure 3:
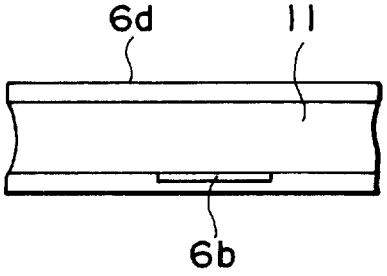
FIG. 3 is an explanation view of a bubble jet recording principle.
Figure 4:
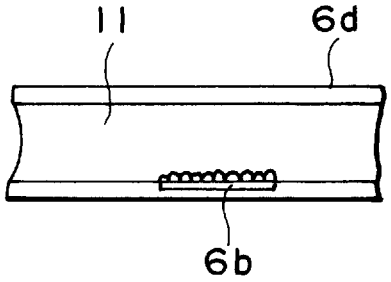
FIG. 4 is an explanation view of a bubble jet recording principle.
Figure 5:
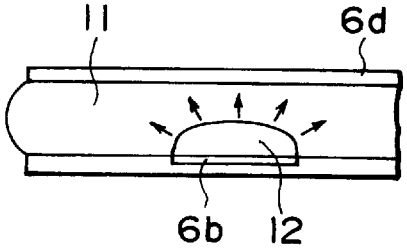
FIG. 5 is an explanation view of a bubble jet recording principle.

Referring to FIGS. 3 to 9, this operation is briefly stated. In a steady state, the ink 11 filled in a nozzle 6*d* has its surface tension in equilibrium with external pressure as shown in FIG. 3. When ink droplets are discharged in this state, electricity-heat converter 6*b* within the nozzle 6*d* is energized, giving rise to rapid temperature elevation exceeding nucleus boilding in the ink within the nozzle 6*d*. Thereby, the ink near the electricity-heat converter 6*b* is heated to generate a minute bubble, and heated ink is vaporized to cause film boiling, as shown in FIG. 4, so that the bubble 12 rapidly grows, as shown in FIG. 5.

Figure 6:
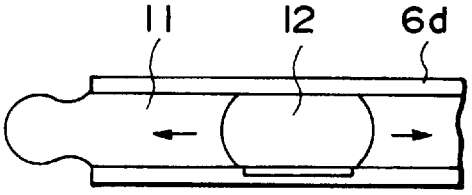
FIG. 6 is an explanation view of a bubble jet recording principle.
Figure 7:
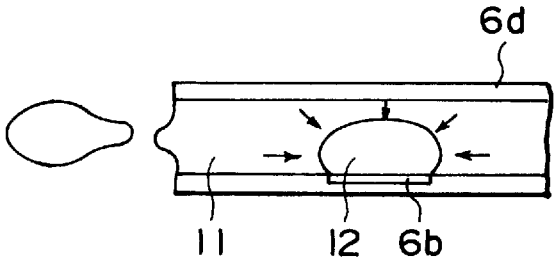
FIG. 7 is an explanation view of a bubble jet recording principle.
Figure 8:
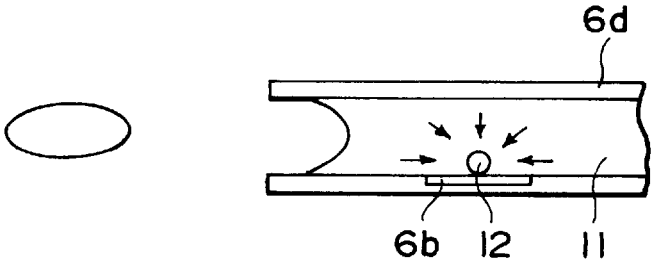
FIG. 8 is an explanation view of a bubble jet recording principle.
Figure 9:
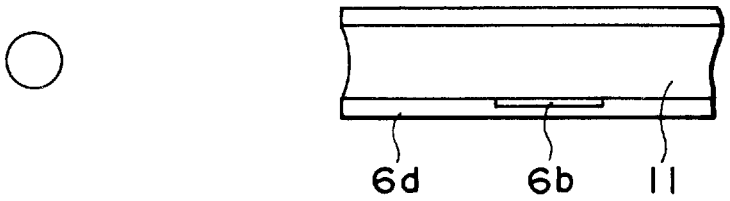
FIG. 9 is an explanation view of a bubble jet recording principle.

If the bubble 12 grows to the most extent as shown in FIG. 6, an ink droplet is forced out from a discharge orifice within the nozzle 6*d*. The energization of electricity-heat converter 6*b* is terminated, so that the grown bubble 12 is cooled and shrunk by the ink within the nozzle 6*d* as shown in FIG. 7. Thus, an ink droplet is discharged through the discharge orifice by this growth and shrinkage of the bubble. Further, the ink makes contact with a surface of the electricity-heat converter 6*b* as shown in FIG. 8, and then is rapidly coo led, so that the bubble extinguishes or shrinks to an almost ignorable volume. And if the bubble 12 shrinks, the ink is further supplied from the common liquid chamber 6*g* into the nozzle 6*d* as shown in FIG. 9, owing to capillary phenomenon, for the preparation of the next energization.

Accordingly, the carriage is moved in reciprocating motion, while an ink image can be recorded on the recording sheet by energizing the electricity-heat converters 6*b* in synchronism with this movement, and in accordance with a pulsed driving signal. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

Also, addition of a restoration means for the recording means, a preliminary auxiliary means, etc. provided at a home position of the carriage as the constitution of the recording device is preferable. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

(Carriage)

Carriage 8 is mounted slidably and rotatably around a slide rail 8*a*, as shown in FIG. 1, wherein the carriage 8 is moved reciprocatingly along the slide rail 8*a* in a width direction of recording sheet 2 by a carriage motor and a drive transmission system (not shown).

A home position sensor for detecting the carriage 8 at the home position thereof is provided, wherein when the carriage 8 is located at the home position, it is out of the area of recording sheet 2 (position in FIG. 1).

(Sheet Hold Down Member)

Sheet hold down member 7 prevents the recording sheet 2 from floating during the recording, having an upstream sheet hold down member 7*a* provided upstream in a conveyance direction of the recording sheet 2 and a downstream sheet hold down member 7*b* provided downstream in the conveyance direction of recording sheet 2, with a reference of the recording region of recording sheet 2 to be recorded with the movement of recording head 6. The upstream sheet hold down member 7*a* has arm portions 7*a*2 bent at both ends of a hold down portion 7*a*1 having a length greater than the width of recording sheet 2, as shown in FIG. 1, each arm portion 7*a*2 being supported rotatably around a shaft 13 (FIG. 10).

Figure 12:
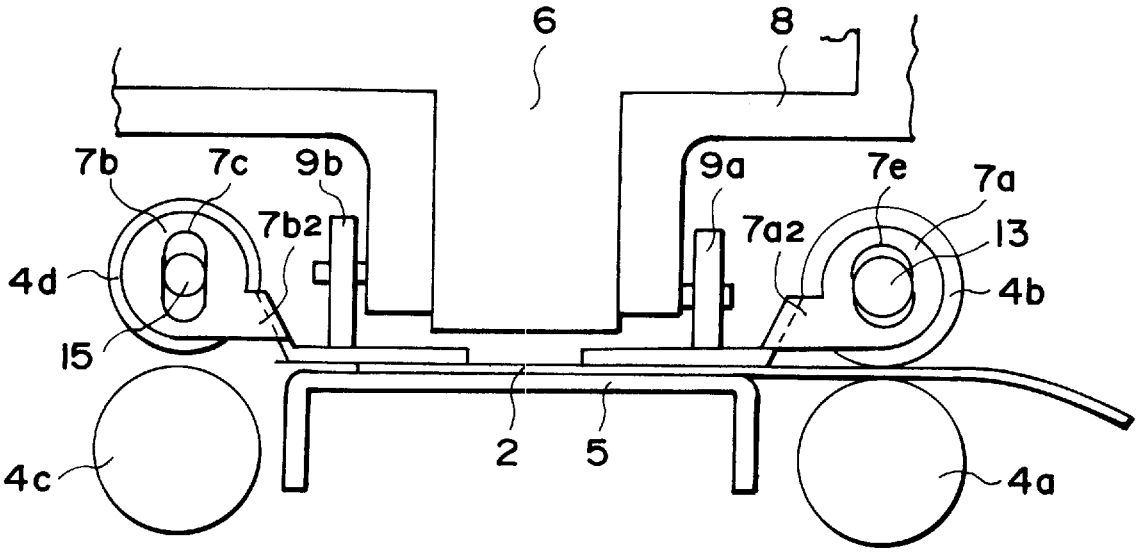
FIG. 12 is a detailed explanation view for sheet hold down members.

Herein, a support shaft engaging portion 7*e* of the arm portion 7*a*2 is formed as a long round hole 7*e* extending longitudinally, as shown in FIG. 12, whereby the arm portion 7*a*2 is movable longitudinally by the minute amount at the same time with the rotation. A slant portion 7*a*3 is formed at one end of the hold down portion 7*a*1 in a longitudinal direction to facilitate a pressing roller 9*a* mounted on a bottom portion of the carriage 8 as will be described later to ride on the hold down portion 7*a*1.

Figure 10:
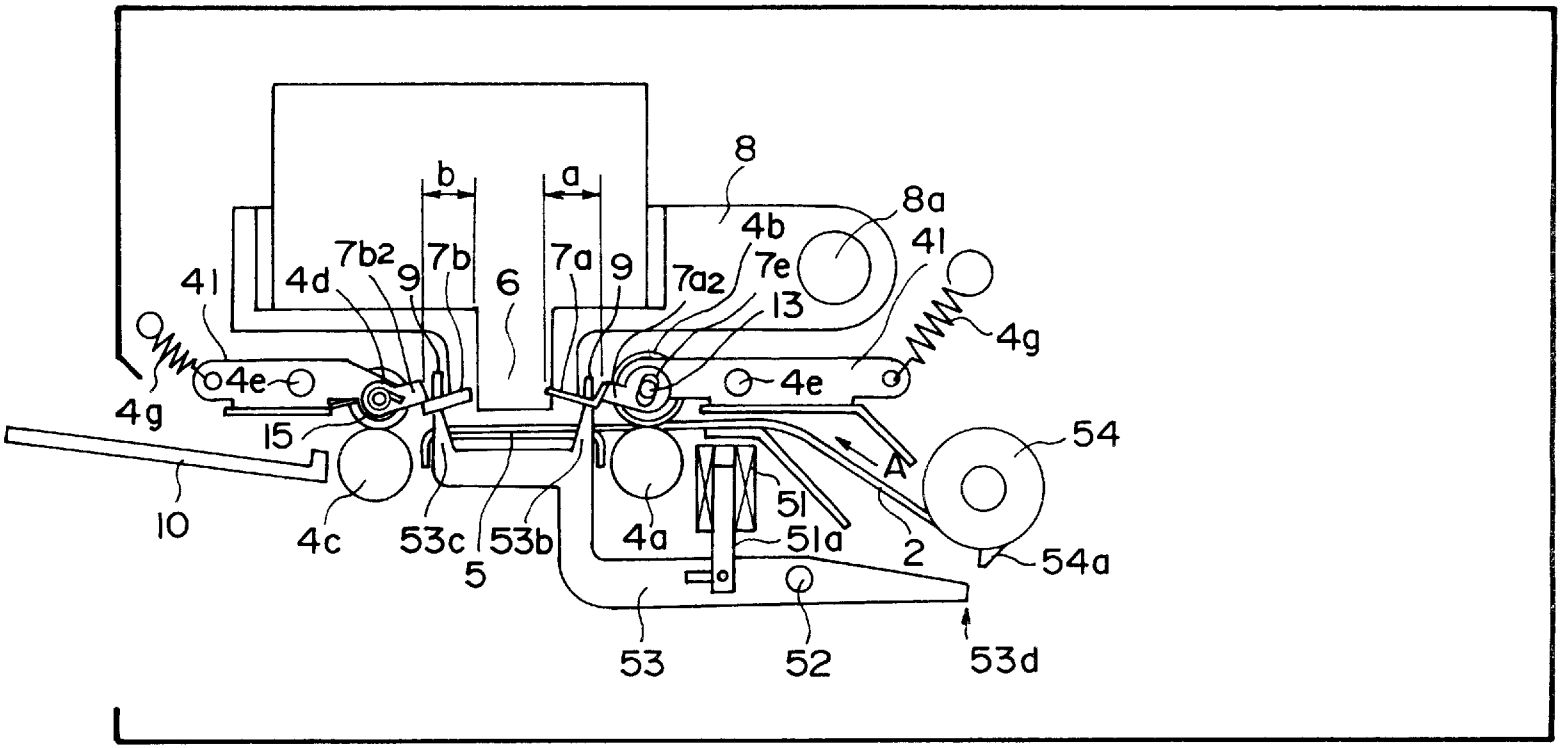
FIG. 10 is a cross-sectional explanation view in a state where sheet hold down members are spaced away from the platen.

On the other hand, the downstream sheet hold down member 7*b* has arm portions 7*b*2 bent at both ends of a hold down portion 7*b*1 having a length greater than the width of recording sheet 2, like the upstream sheet hold down member 7*a*, each arm portion 7*b*2 being engaged in a shaft 15, as shown in FIG. 10. That is, an engaging hole 7*c* of the arm portion with the shaft 15 is a round long hole, whereby the arm portion 7*b*2 is movable longitudinally by the minute amount.

A slant portion 7b3 is formed at one end of the hold down portion 7b1 in a longitudinal direction to facilitate a pressing roller 9b mounted on a bottom portion of the carriage 8 as will be described later to ride on the hold down portion 7b1.

(Pressing Roller)

Pressing roller 9 presses the sheet hold down members 7a, 7b against the platen 5, comprising an upstream pressing roller 9a and a downstream pressing roller 9b which are provided on the bottom end portion of the carriage 8 in this invention. When the carriage 8 is moved in a direction of arrow d as shown in FIG. 1, the pressing roller 9a rides on the upstream sheet hold down portion 7a1 and the pressing roller 9b rides on the downstream sheet hold down portion 7b1.

(Driving Means for Sheet Hold Down Member)

Figure 11:
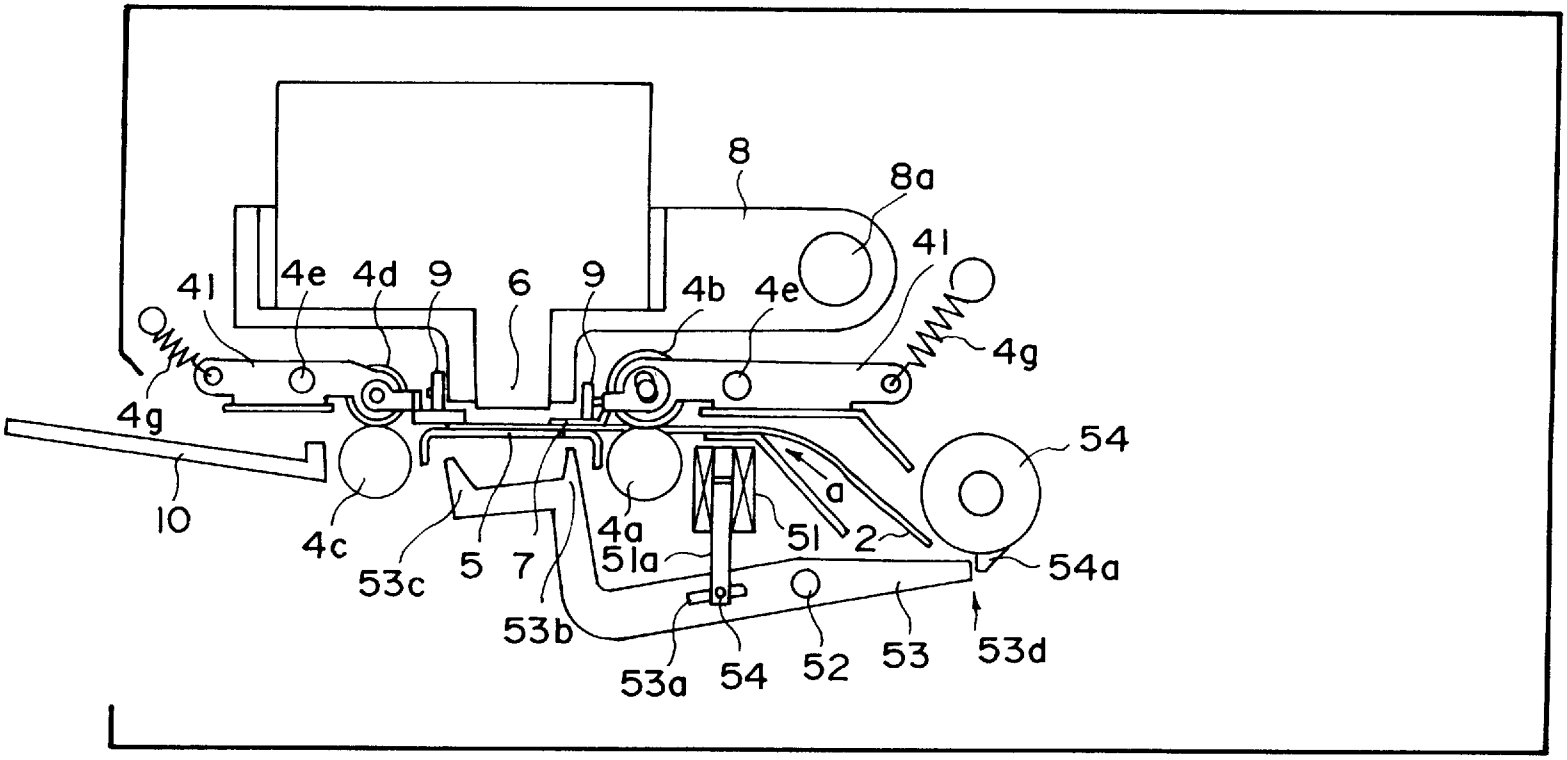
FIG. 11 is an explanation view in a state where a recording sheet is pressed against the platen by pressing member.

51 is a solenoid which is fitted into a fitting hole 53a of an ejector arm 53 rotatable around a shaft 52 via a shaft 54 of a plunger 51a. The ejector arm 53 is rotated by suction of the solenoid 51, causing top portions 53b, 53c thereof to abut against the sheet hold down members 7a, 7b, respectively, and driving the sheet hold down members 7a, 7b to positions out of contact with the sheet (FIG. 10). If the suction of the solenoid 51 is stopped, the sheet hold down members 7a, 7b are swung to positions in close contact with the sheet owing to the gravity (FIG. 11).

(Sheet Supply Means)

Sheet supply rollers 3 convey a recording sheet 2 to a pair of conveying rollers 4a, 4b by separating the sheet from recording sheets 2 within the cassette 1 with the rotation of driving means (not shown). Herein, the rotation of sheet supply rollers 3 is controlled by a sheet supply clutch 54 supported around a sheet roller shaft 60. A well known spring clutch is used for the sheet supply clutch 54, wherein when a control click 54a projected on the sheet supply clutch 54 is engaged with an end portion 53d of arm 53, the clutch spring relaxes to disconnect the drive transmission, stopping the rotation of sheet supply rollers 3 as well as releasing the engagement, whereupon the driving is connected by the clutch spring, so that the sheet supply rollers are rotated by the driving means (not shown).

Figure 14:
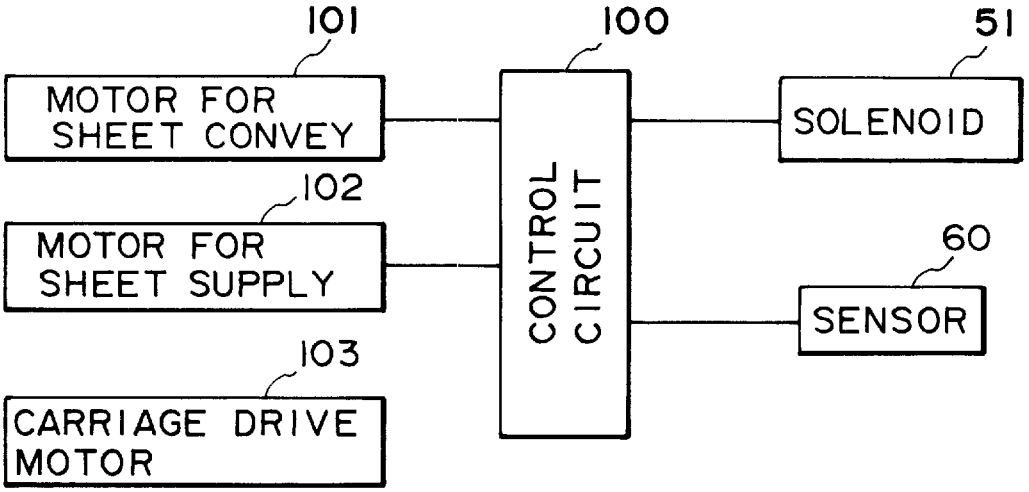
FIG. 14 is a circuit block diagram.

FIG. 14 is a control block diagram of the recording apparatus. 100 is a control circuit including a CPU, 101 is a motor for sheet convey for driving a conveying roller 4a and a conveying roller 4c, and 102 is a motor for sheet supply for driving the sheet supply rollers 3. Note that the motor for sheet convey and the motor for sheet supply may be commonly used with a single motor. 60 is a sensor for detecting the presence or absence of sheet near the nip portion of an exhaust roller 4.

In the above constitution, if a sheet supply signal is sent from the external to the control circuit, or issued internally by the control circuit itself, the motor for sheet convey 101 and the motor for sheet supply 102 are driven, so that the conveying roller 4a and the exhaust roller 4c are rotated counterclockwise in FIG. 10. At the same time, the solenoid 51 is excited, the plunger 51a is sucked and the ejection arm 53 is rotated around the shaft 52, as shown in FIG. 10, and upon abutment of the top portions 53b, 53c, the sheet hold down members 7a, 7b are swung in a direction of leaving away from the platen plate 5. At the same time, the engagement of a sheet supply clutch click 54a with an ejection arm end portion 53d is released, whereby the recording sheet 2 is delivered with the rotation of sheet supply rollers 3 by driving means (not shown) toward the conveying roller 4a and the exhaust roller 4c. Herein, as the sheet hold down members 7a, 7b are held upward of the platen plate 5, the recording sheet is conveyed in a state out of contact with the sheet hold down members 7a, 7b. If a leading portion 2a of the recording sheet 2 passes through hold down areas a, b of the sheet hold down members, that is, a predetermined time after the solenoid 51 is turned on, the suction of the solenoid is stopped. Thereby, the ejection arm 53 is rotated counterclockwise under gravity. Then the sheet hold down member 7a is rotated counterclockwise, and the sheet hold down member 7b is rotated clockwise, under gravity, so that they are placed into close contact with the recording sheet 2, as shown in FIG. 11.

At the same time, the arm end portion 53d moves to a position engagable with the sheet supply clutch control click 54a, in which as the control click 54a is provided only at one position, the sheet supply rollers 3 are rotated once to an initial position, so that the control click 54a is engaged with the arm end portion 53d and the rotation of sheet supply rollers 3 is stopped. At the same time with or a short period of time after the stop of rotation of the sheet supply rollers 3, the motor for sheet convey 101 is stopped. This timing is detected by counting a predetermined time since the rotation of the motor for sheet convey 101 is started.

Also, in a state where the sheet hold down member 7b downstream in the conveying direction of recording sheet is swung and held upward as shown in FIG. 10, it is held like a reversed V extended on the upstream side in the conveying direction, whereby even if there occurs a curl on the leading portion of recording sheet 2, the recording sheet is guided by an under surface of the sheet hold down member 7b to be unwarped stably and led to the roller 4c.

Then, the carriage 8 is driven by driving means 103 in a direction perpendicular to the sheet face to make the scan while the ink is discharged from the head 6, whereby the recording operation is performed. At this time, even if the height of shaft 15 from the platen plate 5 and the height of shaft 13 therefrom are different from predetermined heights due to misalignment, as shown in FIG. 12, such differences will be absorbed between a round long fitting hole 7c of the hold down member 7b and the shaft 15, and between a fitting hole 7e of the hold down member 7a and the shaft 13, so that the secure close contact between the sheet hold down members 7a, 7b and the recording sheet 2 can be assured under gravity of the sheet hold down members.

Also, the sheet hold down members 7a, 7b are brought into close contact with the recording sheet 2 under gravity and owing to the pressing rollers 9a, 9b, but there is no danger that the sheet hold down members 7a, 7b get in contact with the recording head 6 due to the deformation because there are no other forces which may cause deformation. If the scanning of the carriage for one time of print is terminated, the carriage returns to the home position, and subsequently, a sheet feed operation by the amount of a print width is carried out by driving the motor for sheet convey 101 for a predetermined time. If the entire area of the sheet has been printed by repeating the print and sheet feed operation predetermined times, the sheet is exhausted on to the tray 10.

Figure 13:
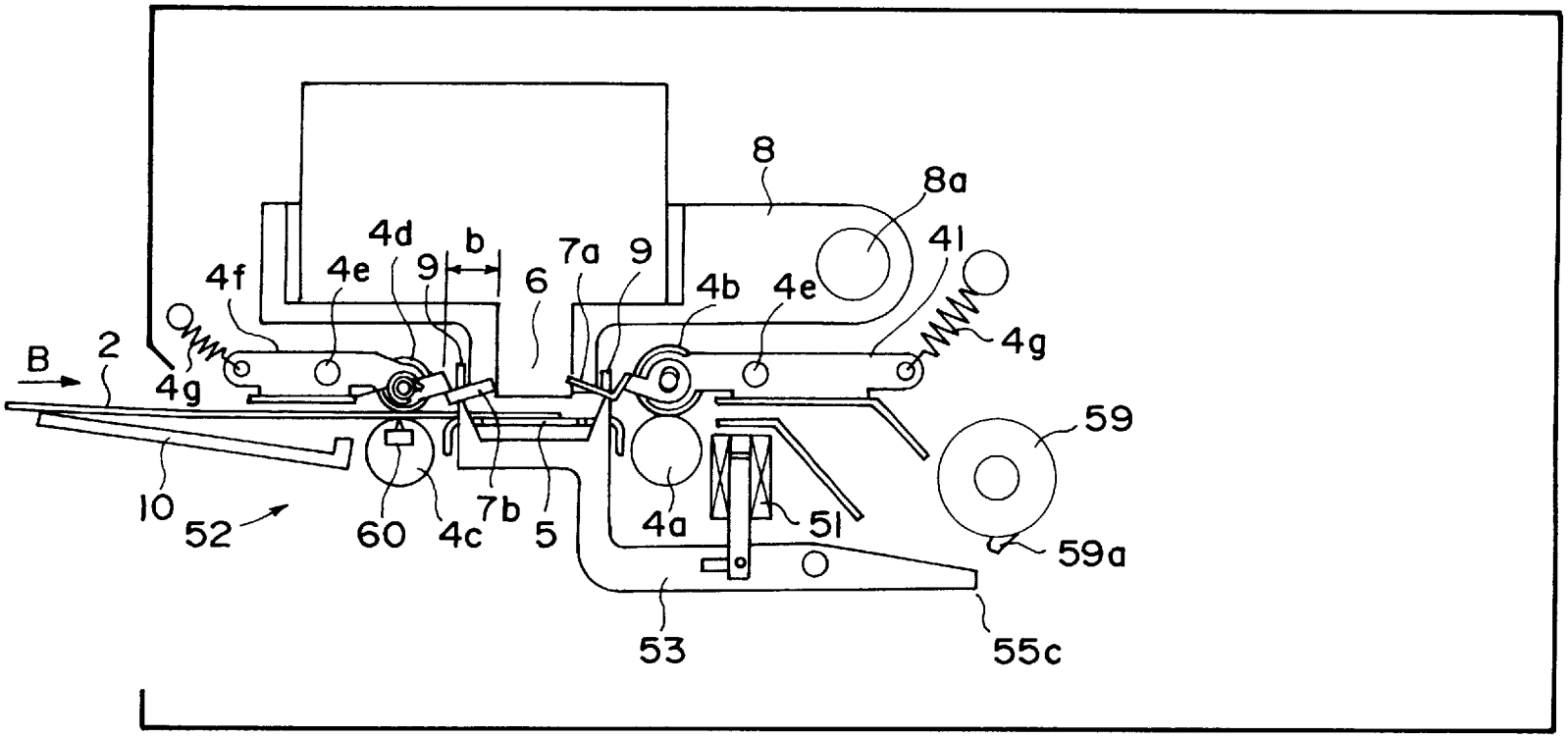
FIG. 13 is a cross-sectional explanation view for the manual sheet supply.

Next, a case where a sheet is inserted manually through an exhaust port will be described below with reference to FIG. 13.

If a recording sheet 2 is inserted between exhaust rollers, the recording sheet 2 is detected by a sensor 60, and if a detection signal is issued, the sheet exhaust roller 4c and the conveying roller 4*a* are rotated conversely to feed the recording sheet 2 in a direction of arrow B toward the inside of apparatus. Also, if the detection signal is issued, the solenoid 51 is excited, whereby the sheet hold down members 7*a*, 7*b* are held out of close contact with the recording sheet 2. At this time, the sheet hold down member 7*a* downstream of conveying the recording sheet is held like reversed V extended on the upstream side in the conveying direction, whereby even if there occurs a curl at the leading portion of recording sheet 2, the recording sheet is guided by an under surface of the sheet hold down member 7*a* to be led to the nip between a pair of rollers 4*a*, 4*b*.

The sheet is further fed and stopped before a trailing end of the sheet passes out of the hold down area. This timing is also determined by an elapsed time since the rotation of the motor for sheet convey is started. Meanwhile, since the solenoid 51 is sucked, an end portion 53*d* of the ejection arm 53 on the sheet supply side is separated from a control annulus 54 of the sheet supply clutch. There is no problem if the motor for sheet supply is controlled to be turned off. However, when it is commonly used with the conveying motor, the sheet supply rollers 3 are driven in a direction opposite to the rotational direction of sheet supply, but no driving force is transmitted because of the rotation in a slack clutch spring, so that the sheet supply rollers 3 are not rotated.

Then, the suction of solenoid 51 is stopped, the ejection arm 53 is rotated counterclockwise so that the sheet hold down members 7*a*, 7*b* are placed into close contact with the recording sheet. Thereafter, the conveying roller is rotated positively to perform the step feed by the fixed amount. The print operation while the carriage is moved reciprocatingly for each step feed is the same as previously described, and the explanation thereof is omitted.

While the bubble jet recording method is used for recording means in the above-described embodiment, as the constitution of the recording head, in addition to the combination of the discharging orifice, liquid channel, and electricity-heat converter (linear liquid channel or right-angled liquid channel) as previously described, the constitution by use of U.S. Pat. No. 4,558,333 or 4,459,600 disclosing the constitution having the heat acting portion arranged in the flexed region is also effectively used in the present invention. In addition, the present invention can be also effectively made the constitution as disclosed in Japanese Patent Appln. Laid-Open No. 59-12370 which discloses the constitution using a slit common to a plurality of electricity-heat converters or Japanese Patent Appln. Laid-Open No. 59-138461 which discloses the constitution having the opening for absorbing pressure wave of heat energy correspondent to the discharging portion. That is, in whatever form the recording head may be, the bubble jet recording method allows for the efficient and secure recording.

The present invention is effective for a recording head fixed to the main device, or a recording head of the freely exchangeable chip type which enables electrical connection to the main device or supply of ink from the main device, or a recording head of the cartridge type having an ink tank integrally formed on the recording head itself.

Further, as the type of the recording head to be mounted and the number of heads, the present invention is effective to a single recording head provided corresponding to monochrome ink or a plurality of recording heads provided corresponding to a plurality of inks having different recording colors or densities, for example. That is, as the recording mode of the recording device, the present invention is extremely effective for not only the recording head only of a primary color such as black, etc., but also a device equipped with at least one of plural different colors or full color by color mixing, whether the recording head may be either integrally constituted or combined in plural number.

Though the ink is considered as the liquid in the embodiment as above described, the present invention is applicable to either of the ink solid below room temperature, and softening or liquefying at or above room temperature, or the ink liquefying when a recording enable signal is issued as it is common with the ink jet device to control the viscosity of ink to be maintained within a certain range of the stable discharge by adjusting the temperature of ink in a range from 30° to 70° C. In addition, in order to avoid the temperature elevation due to the heat energy by positively utilizing the heat energy as the energy for the change of state from solid to liquid, or to prevent the ink from evaporating by the use of the ink stiffening in the shelf state, the ink having a property of liquefying only with the application of heat energy, such as the ink liquefying with the application of heat energy in accordance with a recording signal so that liquid ink is discharged, or the ink already solidifying upon reaching a recording medium, is also applicable in the present invention. In this case, the ink may be in the form of being held in recesses or through holes of porous sheet as liquid or solid matter, and opposed to electricity-heat converters, as described in Japanese Patent Appln. Laid-Open No. 54-56847 or 60-71260. The most effective method for inks as above described in the present invention is based on the film boiling.

Further, while in the previously-described embodiment, the bubble jet recording method is exemplified for recording means, a wire dot recording method or other recording methods may be used. The conveying means for recording sheet is not limited to a roller form as in the previously-described embodiment, but a conveying force by means of a rotation belt or the like may be applied to the recording sheet 2.

Further, the recording apparatus may be used in the form of an image output terminal in the information processing equipment such as a computer, a copying machine in combination with a reader, or a facsimile terminal equipment having the transmission and reception feature. While the sheet hold down member in this embodiment is disposed at two places upstream and downstream in the sheet conveying direction, it will be appreciated that it may be disposed on either upstream or downstream side.

Figure 15:
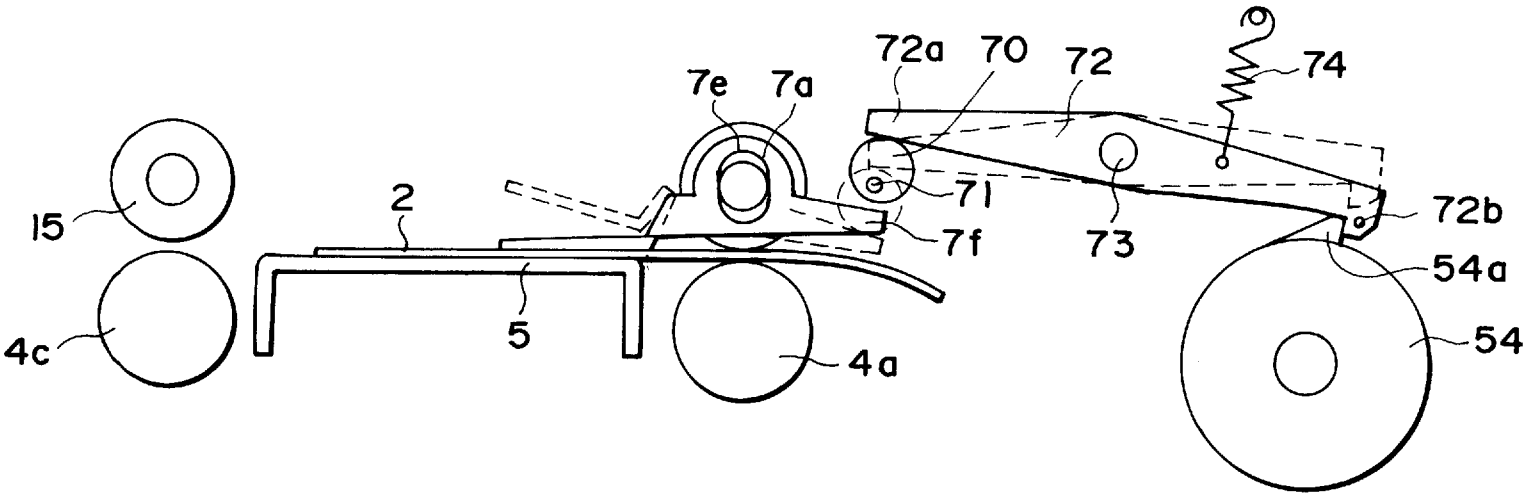
FIG. 15 is a view showing another embodiment.

While driving means for swinging the sheet hold down member is exemplified in the constitution using the solenoid and the ejection arm, other driving means such as cams 70, 71 as shown in FIG. 15 may be used. 70 is an eccentric cam, wherein if it is rotated around an axis 61 by driving means (not shown), it abuts and presses against an end portion 7*f* of sheet hold down member 7, whereby the sheet hold down means 7*a* is rotated to a position as indicated by the broken line.

72 is a link arm which is rotated around a shaft 73 and urged counterclockwise by a spring 74. The link arm is brought into direct contact with the eccentric cam 70 at one end 72*a* thereof, and is engaged with a control click 54*a* of sheet supply clutch 54 at the other end 72*b* thereof. With the rotation of the eccentric cam, the link arm 72 is rotated to a position as indicated by the broken line out of the engagement with the control click 54*a*, whereby the sheet supply rollers (not shown) are rotated to perform the sheet supply operation.

Figure 16:
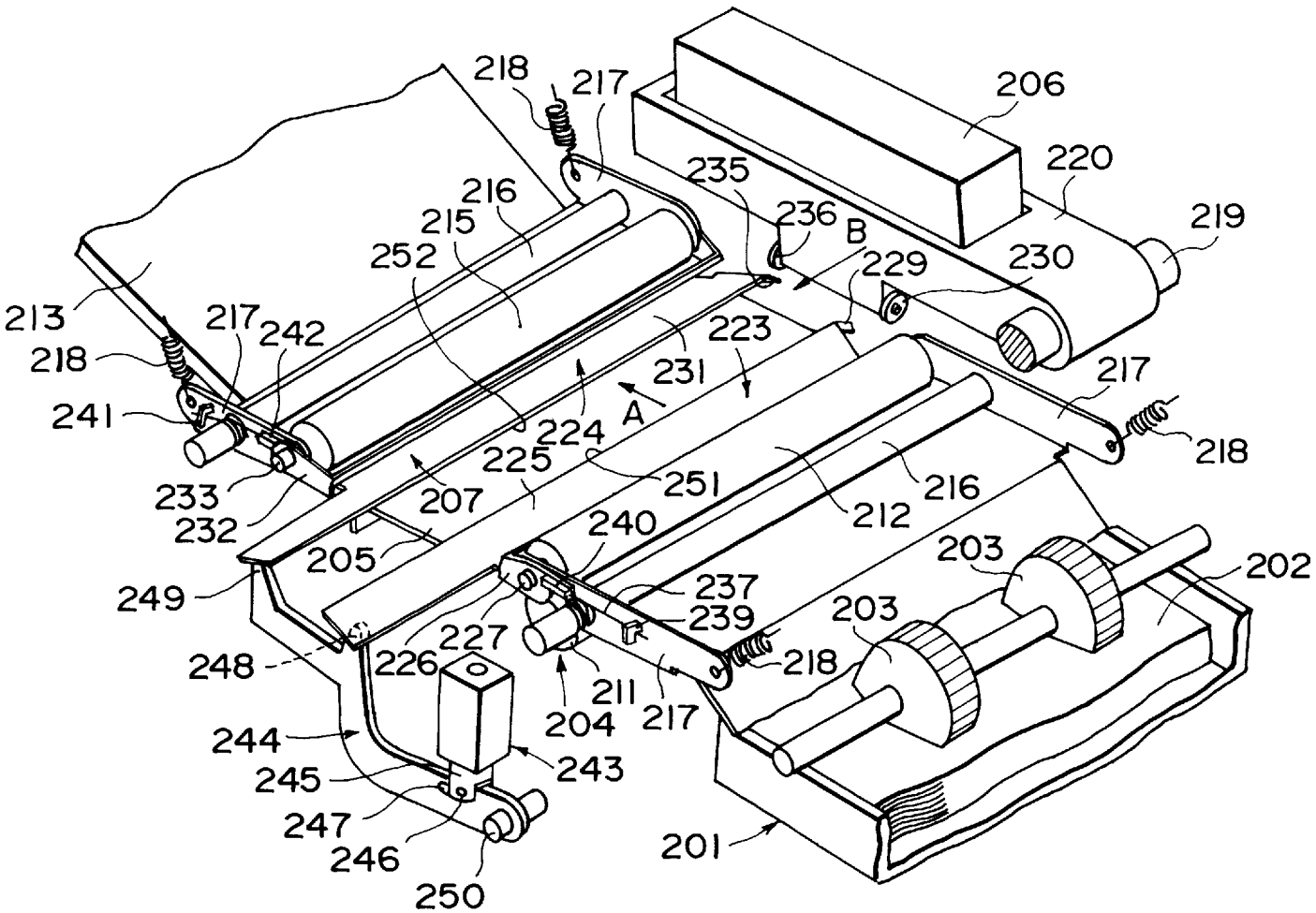
FIG. 16 is a schematic perspective view showing the constitution of a recording apparatus, in essential parts thereof, to which this invention is applied.
Figure 17:
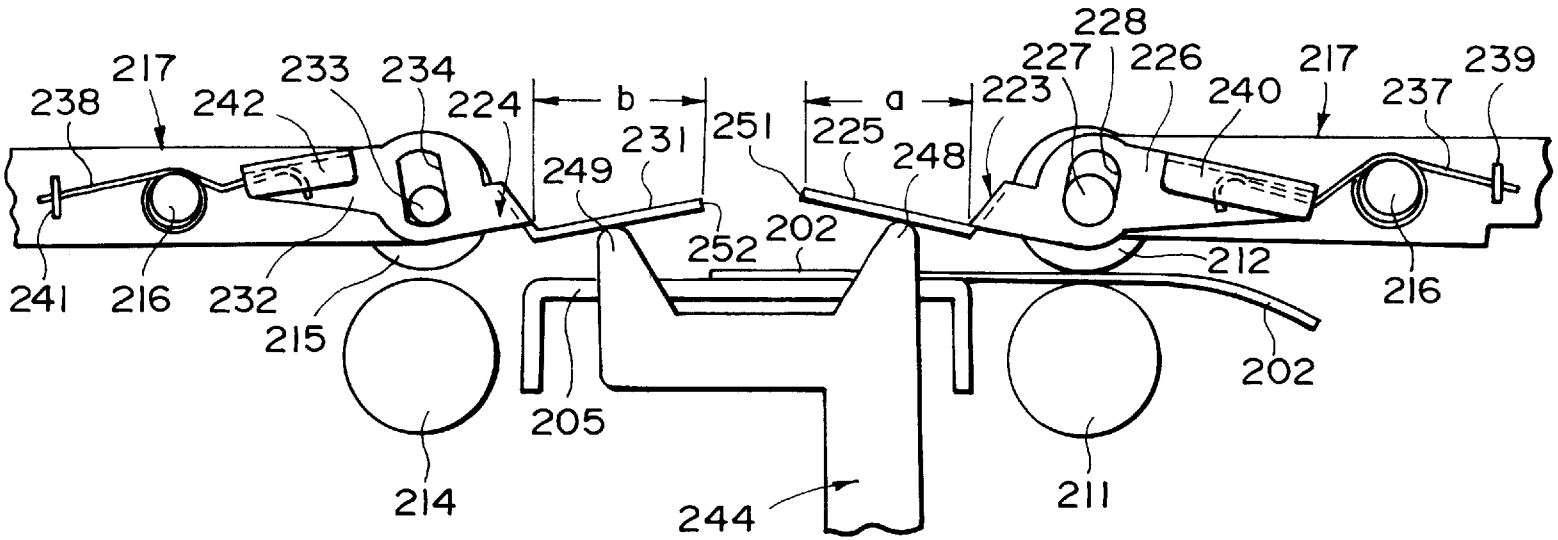
FIG. 17 is a partial side view showing a state of the recording apparatus of FIG. 16 in conveying a recording sheet.
Figure 18:
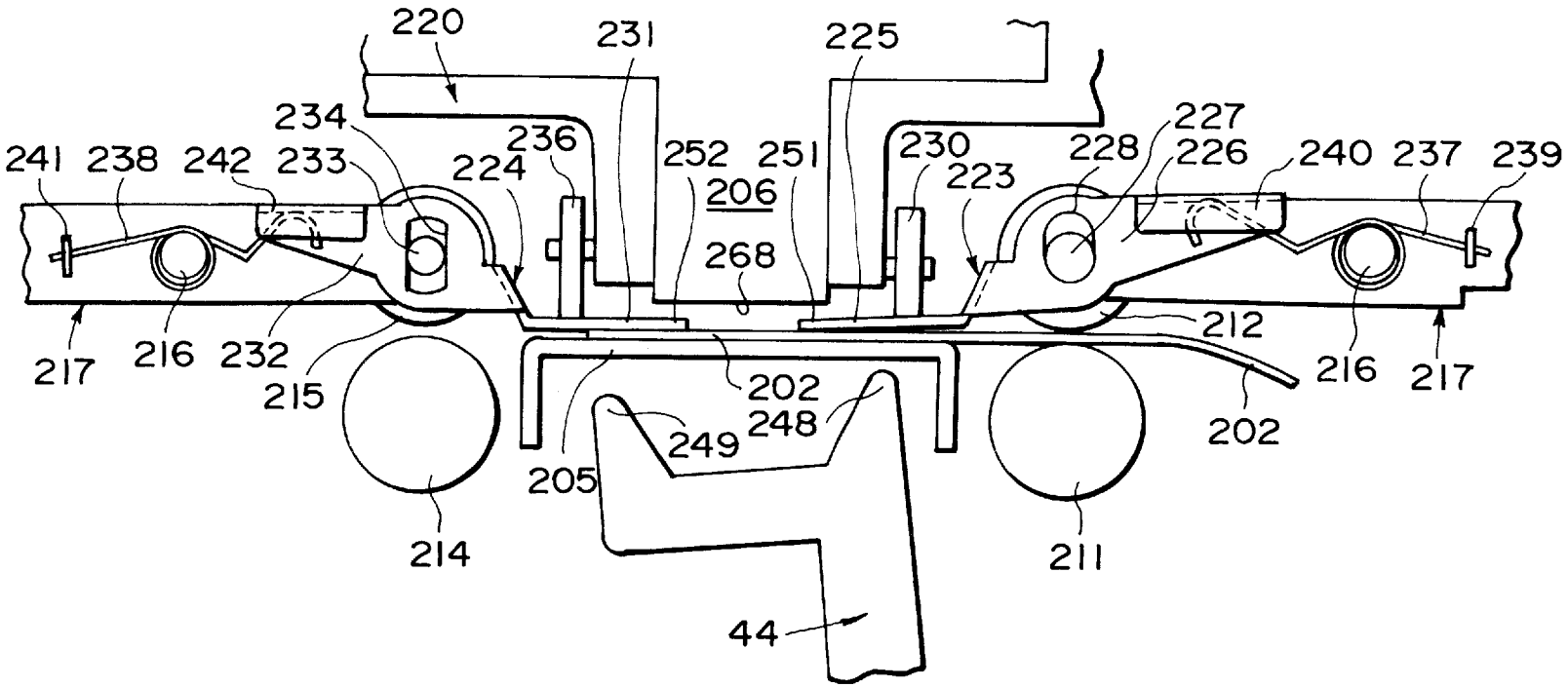
FIG. 18 is a partial side view showing a state of the recording apparatus of FIG. 16 in recording.

In the following, another embodiment of the present invention will be described with reference to the drawings. FIG. 16 is a schematic perspective view showing the constitution of a recording apparatus, in essential parts thereof, according to another embodiment of the present invention. FIGS. 17 and 18 are side views showing the constitution of recording sheet conveying means and recording sheet hold down mechanism for the recording apparatus of FIG. 16.

This recording apparatus is configured in such a manner as to supply recording sheets 202 such as papers or plastic thin plates stacked within a cassette 201, one by one, with pickup rollers 203, convey a recording sheet 202 with recording sheet conveying means 204, and drive a recording head (recording means) 206 to perform the recording onto the recording sheet 202 supported on a platen 205 with its back surface, as shown in FIG. 16. Also, recording sheet hold down mechanism 207 is provided near a recording region to prevent the recording sheet 202 from floating or slacking at the recording position of recording sheet 202 in recording. Next, the configuration of each component of the recording apparatus will be described below.

Recording sheet conveying means 204

Recording sheet conveying means 204 comprises a conveying roller 211 and a pinch roller 212 for conveying the recording sheet 202 to recording area, and an exhaust roller 214 and a pinch roller 215 for exhausting recorded sheet 2 to an exhaust tray 213. The conveying roller 211 and the exhaust roller 214 can be driven by a convey motor (not shown). The pinch rollers 212, 215 are mounted at one end portions of arms 217, 217 rotatable around shafts 216, 216, respectively, and compressed against the conveying roller 211 and the exhaust roller 214 by springs 218, 218 attached at other end portions of the arms, respectively. Thereby, the recording sheet conveying means 204 conveys a recording sheet 202 in a direction of arrow A of FIG. 16, when driven by the convey motor. Note that the exhaust roller 214 is driven by the same motor as the conveying roller 211, with its peripheral speed being several percent higher than that of the conveying roller 211, so that an adequate tension is applied to the recording sheet 202 to be conveyed.

Recording means (recording head) 206

Recording means 206 records an image onto a recording sheet 202 to be conveyed. An ink jet recording head is used as the recording head 206 in this recording apparatus. Among the ink jet recording heads, this recording head 206 discharges the ink with the heat energy in which electricity-heat converters are provided for generating the heat energy. The recording head 206 performs the recording by discharging the ink through discharge orifices using the pressure difference produced by growth and shrinkage of bubbles with film boiling caused by heat energy applied from the electricity-heat converters. The details thereof are the same as previously described in FIGS. 2 to 9.

In this embodiment, the recording head 206 is mounted on the carriage 220 guided and supported to be movable reciprocatingly along a guide shaft 219 in directions crosswise to a conveying direction A of the recording sheet 202. The recording head 206 has its discharge orifice formation face 268 opposed to the recording sheet 202 spaced at a predetermined interval therefrom (e.g., about 0.5 to 2.0 millimeter), and is mounted on the carriage 220 with a plurality of discharge orifices being placed substantially parallel to the recording sheet conveying direction A. Thus, the recording head 206 is constituted such that the ink is discharged through discharge orifices with the pressure produced by film boiling occurring in the ink within the liquid channels by driving (energizing) the electricity-heat converters correspondingly to an image signal (recording information) and in synchronism with the movement of the carriage 220.

Carriage 220

Carriage 220 is mounted slidably around a guide shaft 219, as shown in FIG. 16, wherein the carriage 220 is moved reciprocatingly along the guide shaft 219 in a width direction of the recording sheet 2 by a carriage motor and a transmission mechanism (both not shown). The recording apparatus is provided with a home position sensor for detecting the carriage 220 at the home position. The home position is out of the area of recording sheet 202, and FIG. 16 shows a state where the carriage 220 is located at the home position.

Recording sheet hold down mechanism 207

Recording sheet hold down mechanism 207 prevents the recording sheet 202 from floating during the recording. The recording sheet hold down mechanism 207 as shown in FIGS. 16 to 18 comprises an upstream sheet hold down member 223 for pressing the recording sheet 202 upstream in a conveyance direction of the recording sheet 202 and a downstream sheet hold down member 224 for pressing the recording sheet downstream in the conveyance direction of recording sheet 202, with a reference of the recording region to be recorded by the recording head 206. Note that the recording sheet hold down mechanism may be constructed of either one of the upstream recording sheet hold down member 223 and the downstream recording sheet hold down member 224, to which the present invention can be also applied. The recording sheet 202 may be conveyed in a return direction as necessary, in which case the upstream side and the downstream side are reversed.

The upstream sheet hold down member 223 has a hold down portion 225 having a length greater than the width of recording sheet 202, arm portions 226, 226 extending at right angles from both ends of the hold down portion 225, which are supported rotatably around a shaft 227 fitted with the arm portions. In this embodiment, a shank of a pinch roller 212 is used as this shaft 227. Herein, the fitting of each arm portion 226 with the shaft 227 is made by a long hole 228 (FIG. 17, FIG. 18) extending vertically and formed in the arm portion 226, whereby the upstream recording sheet hold down member 223 is supported around the shaft to be movable vertically by a predetermined amount, as well as being rotatable. A slant portion 229 is formed at one end of the hold down portion 225 for the upstream recording sheet hold down member 223 in a longitudinal direction to facilitate a presser roller 230 mounted on a bottom portion of the carriage 220 to ride on the hold down portion 225.

On the other hand, the downstream recording sheet hold down member 224 has the same structure, comprising a hold down portion 231 having a length greater than the width of recording sheet 202, arm portions 232, 232 extending at right angles from both ends of the hold down portion 231, which is rotatably supported around a shaft 233 fitted with the arm portions. In this embodiment, a shank of a pinch roller 215 is used as this shaft 233. Herein, the fitting of each arm portion 232 with the shaft 233 is made by a long hole 234 (FIG. 17, FIG. 18) extending vertically and formed in the arm portion 232, whereby the downstream recording sheet hold down member 224 is supported around the shaft to be movable vertically by a predetermined amount, as well as being rotatable. A slant portion 235 is formed at one end of the hold down portion 231 for the downstream recording sheet hold down member 224 in a longitudinal direction of the hold down portion 231 to facilitate a presser roller 236 mounted on a bottom portion of the carriage 220 to ride on the hold down portion 231.

Presser means

Presser means presses the recording sheet hold down members 223, 224 against the platen 205, comprising presser roller 230, 236 rotatably supported around axles under the carriage 220 in this embodiment. Presser roller 230 is disposed to press the upstream recording sheet hold down member 223, while presser roller 236 is disposed to press the downstream recording sheet hold down member 224. When the carriage 220 is moved in a direction of arrow B in FIG. 16, the presser rollers 230, 236 ride on the hold down portions 225, 231 of recording sheet hold down members 223, 224 via the slant portions 229, 235, respectively.

Biasing means for recording sheet hold down member

Biasing means biases the recording sheet hold down members 223, 224 to a direction to be spaced away from the recording head 206, comprising biasing springs 237, 238. In this embodiment, a torsion coil spring is used as these biasing springs 237, 238. A spring 237 is retained around a shaft 216 of the arm 217 (for the pinch roller 212) on the upstream side, with one end being engaged to an engagement portion 239 of the arm 217, and the other end abutting from beneath on a trailing end 240 of the upstream recording sheet hold down member 223, whereby the recording sheet hold down member 223 is biased counterclockwise in FIG. 17. On the other hand, a spring 238 is retained around a shaft 216 of the arm 217 (for the pinch roller 215) on the downstream side, with one end being engaged to an engagement portion 241 of the arm 217, and the other end abutting from beneath on a trailing end 242 of the upstream recording sheet hold down member 224, whereby the recording sheet hold down member 224 is biased clockwise in FIG. 17. Note that the trailing ends 240, 242 of recording sheet hold down members 223, 224 are shaped like a character ⊐ opening on the lower side to prevent the end portions of bias springs 237, 238 from being disengaged therefrom.

Driving means for recording sheet hold down member

Driving means moves (or swings) the recording sheet hold down members 223, 224 against the biasing means 237, 238 to a position out of contact with the recording sheet 202. This driving means comprises a solenoid 243 which is attached to a frame (not shown) of the recording apparatus, and a drive arm supported swingably around a shaft 250 on the frame, whereby the driving means can drive a top portion of the drive arm 243 upward as shown by means of the solenoid 243. A movable portion 245 of the solenoid 243 is fitted into a fitting hole 247 of the drive arm 244 via a shaft (pin) 246. At the top portion of drive arm 244 are formed abutment portions 248, 249 to abut against the underside of recording sheet hold down member 223, 224 (hold down portions) 225, 231 at the side end portions thereof.

If the solenoid 243 is turned on, the movable portion 245 is retracted, so that the drive arm 244 is rotated around a shaft 250 clockwise in FIG. 16, and the abutment portions 248, 249 located at the top end of the drive arm 244 are elevated to abut against the lower side of the side end portions (hold down portions) 225, 231 for the recording sheet hold down members 223, 224, whereby the recording sheet hold down members 223, 224 are driven to positions out of contact with the recording sheet 202. On the other hand, if the solenoid 243 is turned off, the drive arm 244 is rotated (returned) around the shaft 250 counterclockwise in FIG. 16, and the abutment portions 248, 249 located at the top end of the drive arm 244 are returned to the lowered position spaced away from the recording sheet hold down members 223, 224, whereby the recording sheet hold down members 223, 224 are swung (returned) to positions in close contact with the recording sheet 202 (or platen 205) by the biasing springs 237, 238. While the driving means as above described are normally provided at both end portions of recording sheet hold down members 223, 224, and are operated simultaneously, it will be appreciated that they may be provided at only one side of recording sheet hold down members 223, 224.

Sheet supply means

Sheet supply means separates one sheet from recording sheets 202 stacked within the cassette 201 by rotating the pickup roller (sheet supply roller) 203 with a driving mechanism (not shown) in FIG. 16, and conveys the recording sheet 202 between the conveying roller 211 and the pinch roller 212, and further between the exhaust roller 214 and the pinch roller 215.

In the following, a series of operations for the recording apparatus will be described. First, if the solenoid 243 is turned on, the drive arm 244 is rotated around the shaft 250, and upon abutment of the top end portions 248, 249 of the drive arm 244, the recording sheet hold down members 223, 224 are rotated in a direction leaving away from the recording sheet 202 (or platen 205) against the biasing springs 237, 238. This state is shown in FIG. 17. By rotating the pickup roller 203 with driving means (not shown), the recording sheet 202 is delivered to the conveying roller 211 and further to the exhaust roller 214. At this time, each recording sheet hold down member 223, 224 is held at a position upwardly spaced from the platen 205, whereby the recording sheet 202 is conveyed without making contact with the recording sheet hold down members 223, 224.

Also, in a stage where the recording sheet hold down member 224 on the downstream side is spaced upward, it is held like a character ⋏ extended on the upstream side, whereby even if there occurs a curl at the leading portion of recording sheet 202, the recording sheet 202 is guided by an under surface of recording sheet hold down member 224 to be conveyed smoothly (in the stable state) into the exhaust roller 214.

After the leading end of the recording sheet 202 passes through hold down areas a, b (FIG. 17) of recording sheet hold down members 223, 224, the solenoid 243 is turned off to rotate the drive arm 244 in a counterclockwise direction (a lower direction leaving away from the recording sheet hold down members 223, 224). Thereby, the recording sheet hold down members 223, 224 are rotated in the direction toward the platen 205 by the biasing springs 237, 238 and under gravity thereof, and the hold down areas a, b at the top end portions thereof are placed into close contact (abutment) with the recording sheet 202.

Next, the carriage 220 is driven along the guide shaft 219 to scan the recording sheet 202 in a width direction, whereby the recording operation is performed using the recording head 206. In this case, the presser rollers 230, 236 supported around shaft under the carriage 220 are rolled along upper surfaces of the hold down portions 225, 231 of the recording sheet hold down members 223, 224, as shown in FIG. 18, whereby the recording sheet 202 is pressed and closely contacted against the platen 205 under gravity of the carriage 220 and the recording head 206.

At this time, an error may occur in some cases in the height of support shaft 227, 233 because the vertical interval between a support shaft 227 of the recording sheet hold down member 223 and an upper surface of the platen 205 or between a support shaft 233 of the recording sheet hold down member 224 and the upper surface of the platen 205 is deviated off a predetermined value. However, since in this embodiment, the support shafts 227, 233 are fitted into vertically long holes 228, 234 provided on the recording sheet hold down members 223, 224, respectively, an error with the above-mentioned height can be absorbed, thereby allowing the recording sheet hold down members 223, 224 to securely make contact with the recording sheet 202 owing to their gravity.

When the contact between the recording sheet hold down member 223 and the recording sheet 202 is insufficient because of the misalignment on the manufacture or assembly, the hold down member 223 is biased in a counterclockwise direction in FIG. 18 by a biasing force of the biasing spring 237, so that the top end portion 251 of the hold down member 223 can be securely brought into close contact with the recording sheet 202. Thereby, it is possible to eliminate any damage on the recording head 206 which is caused by the contact between the recording sheet hold down member 223 and the recording head 206.

Also, likewise, when the contact between another recording sheet hold down member 224 and the recording sheet 202 is insufficient, the hold down member 224 is biased clockwise in FIG. 18 by a biasing force of the biasing spring 238, so that the top end portion 252 of the hold down member 224 can be securely brought into close contact with the recording sheet 202. Thereby, it is also possible to eliminate any damage on the recording head 206 which is caused by the contact between the recording sheet hold down member 224 and the recording head 206.

If one scanning of the carriage 220 is terminated, the carriage 220 is once returned to a home position, and the sheet feed operation (recording sheet conveying operation) is made by a predetermined amount (e.g., recording width= height of one line). If the sheet feed operation is terminated, recording of the next line is performed. The recording operation and the sheet feed operation are alternately performed by predetermined times to record over the entire area of recording sheet 2, and upon the termination of recording, the recording sheet 202 is exhausted on to an exhaust tray 213.

While in the described embodiment the recording sheet hold down members 223, 224 are disposed at two places upstream and downstream in the direction of conveying the recording sheet, it should be noted that the recording sheet hold down member may be disposed at either one of upstream and downstream side thereof. While the biasing means for the recording sheet hold down member 223, 224 is a torsion coil spring in the above embodiment, it will be appreciated that other biasing means such as a tension spring, a compression spring, or a leaf spring may be used instead.

Further, in the above embodiment, there is provided driving means (solenoid 243, driving arm 244) for spacing the recording sheet hold down members 223, 224 away from the recording sheet 202 so as not to obstruct the conveyance of recording sheet 202, but when it is unnecessary to space the recording sheet hold down member away from the recording sheet, for example, when either one of the recording sheet hold down members is always positioned upstream in the conveyance direction, or when a roll paper is used as the recording sheet, the driving means (solenoid 243, drive arm 244) can be omitted.

In the described embodiment, even if there occurs an error in the height of both or either one of the presser members (presser rollers) 230, 236 provided under the carriage 220 from the platen 205 because of the misalignment on the manufacture, at least the top end portion of the recording sheet hold down member 223, 224 can be maintained in close contact with the recording sheet 202, whereby the contact between the recording sheet hold down member 223, 224 and the recording head 206 can be assuredly prevented.

Since the support shafts 227, 233 are fitted into vertical long holes 228, 234 of the recording sheet hold down members 223, 224, respectively, even if an error occurs in the height of the support shaft 227, 233 because the vertical interval between the support shafts 227, 233 and an upper surface of the platen 205 is deviated off a predetermined value, this height error can be absorbed. And since the recording sheet hold down members 223, 224 can be placed into close contact with the recording sheet 202 under gravity, it is possible to avoid securely the contact between the recording sheet hold down members 223, 224 and the recording head 206.

While in the previously described embodiments, the present invention is applied to an ink jet recording apparatus, as an example, the present invention is applicable to various recording apparatuses such as a wire dot recording apparatus, a laser beam recording apparatus, a thermal transfer recording apparatus, or a thermal recording apparatus, irrespective of the recording method with recording means (recording head), with the same effects. Further, while in the previously described embodiments, a serial type recording apparatus comprising recording means (recording head) 6 making the scanning along the recording sheet 2 was exemplified, the present invention is applicable to a line type recording apparatus using line type recording means corresponding to the whole or a part of the recording width for the recording sheet, with the same effects.

Also, the present invention is also applicable to a monochrome recording apparatus using a single recording means, a color recording apparatus using a plurality of recording means for recording with different colors, or a recording apparatus for the gradation recording using a plurality of recording means for recording at different densities of the same color, without regard to the number of recording means, whereby the same action effects can be accomplished. Further, the present invention is also applicable to recording means which is constituted in any form of the recording head and the ink tank, such as a cartridge type having a recording head and an ink tank integrally formed, or a constitution having a recording head and an ink tank separately provided which are connected via an ink supply tube, whereby the same effects can be accomplished.

A further embodiment of the present invention will be described below with reference to the drawings.

Figure 19:
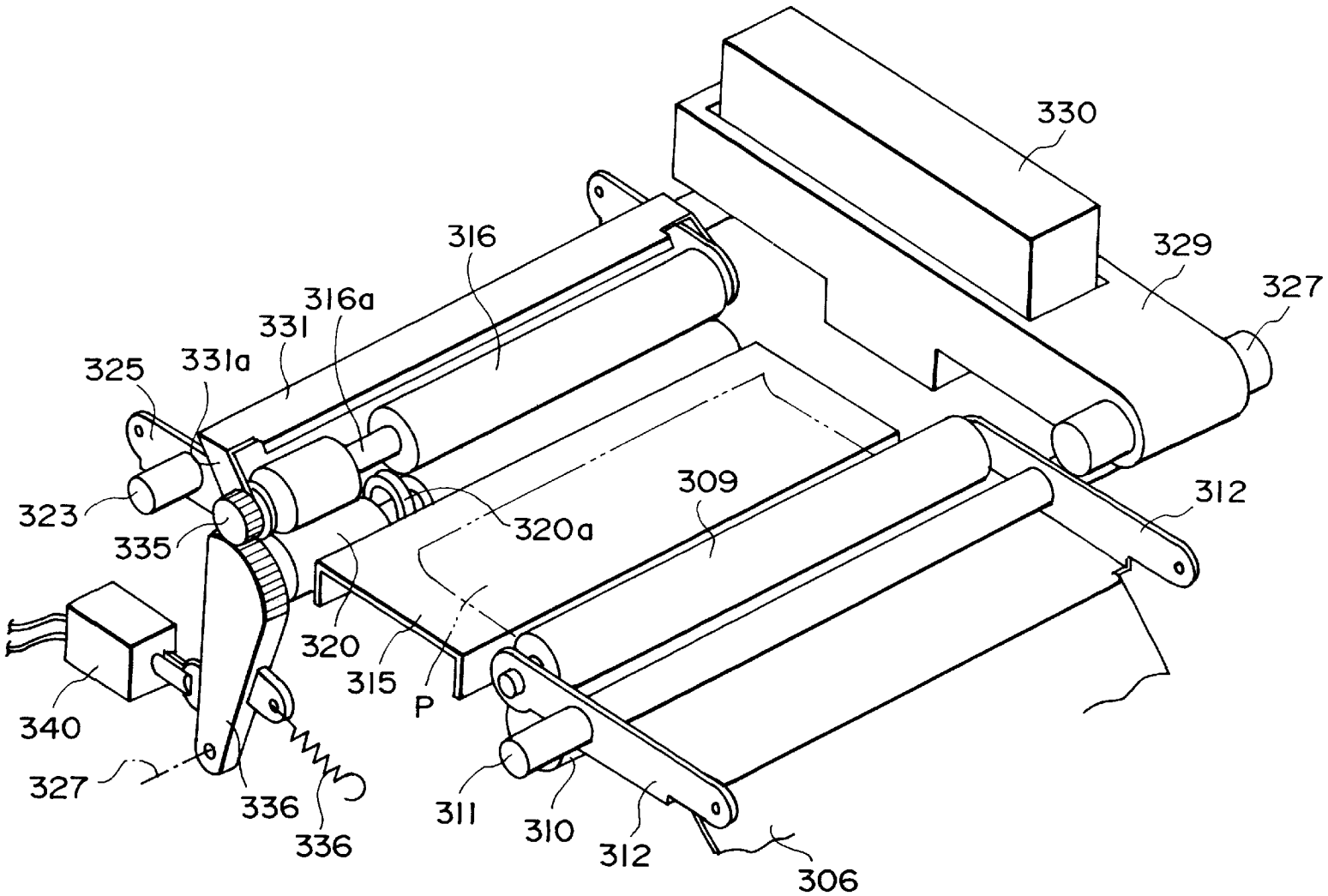
FIG. 19 is a perspective view showing the constitution of a recording apparatus, in essential parts thereof, according to one embodiment of this invention.
Figure 20:
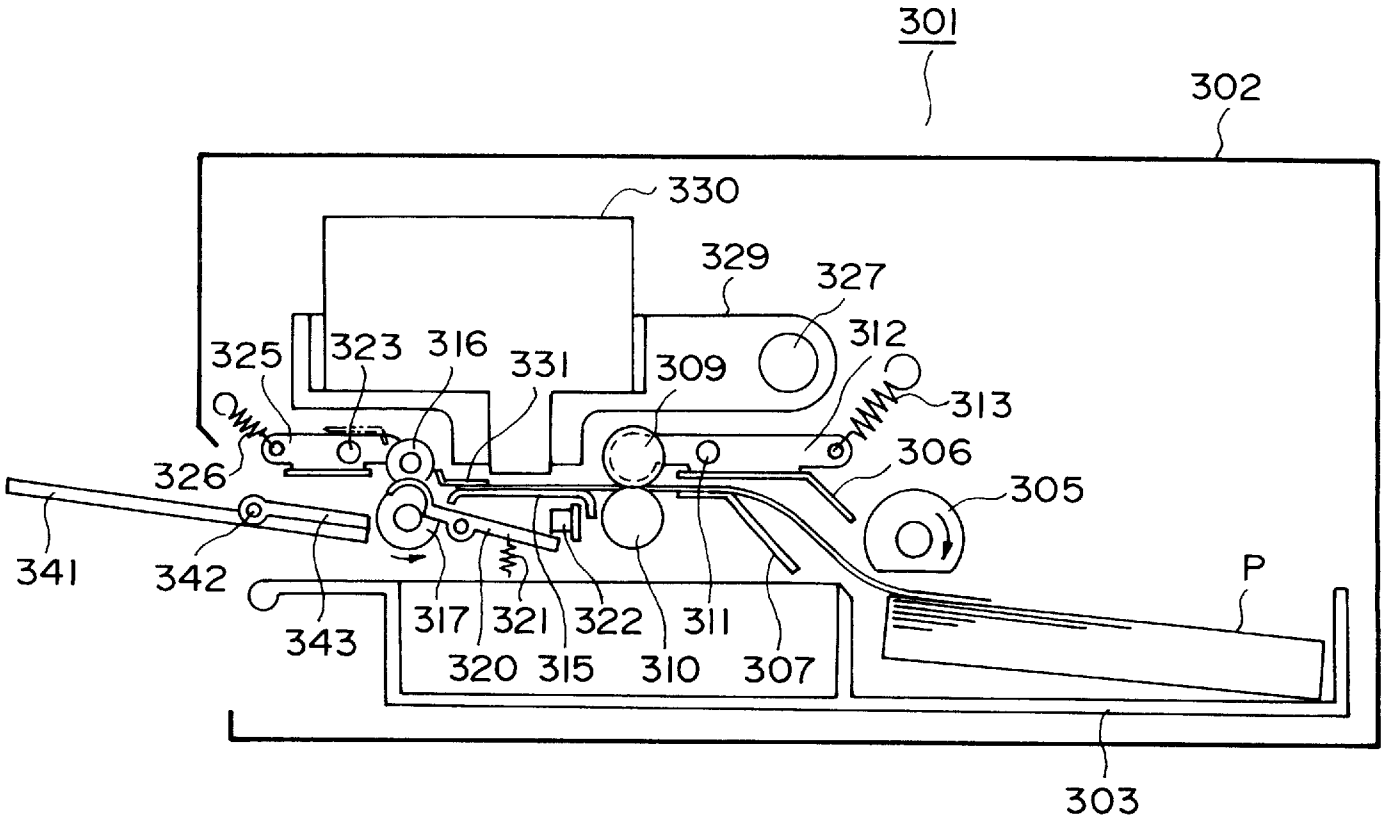
FIG. 20 is a longitudinal side view showing the entirety of the recording apparatus.

FIG. 19 is a perspective view of a recording apparatus according to one embodiment of the present invention, and FIG. 20 is a longitudinal cross-sectional view thereof.

A cassette 303 is disposed under a main body 302 of the recording apparatus 301, and a pickup roller 305 is provided to separate and supply the uppermost one sheet among sheets P stacked within the cassette 303 to deliver it between an upper guide 306 and a lower guide 307. If the pickup roller 305 is rotated once, it is stopped in the shown stage, thereby losing the conveying force, while a leading end of sheet P is carried between a conveying upper roller 309 and a conveying lower roller 310, and the sheet P is thereafter conveyed between these conveying rollers 309, 310. The conveying upper roller 309 is pressed via a pressure plate 312 having a shaft 311 as the fulcrum by a spring 313, and thereby rotated as a follower along with the rotation of the conveying lower roller 310. The conveying lower roller 310 is started to rotate when a sensor 322 and a sensor arm 320 biased by a spring 321 determines the sheet P to be delivered, so that the sheet P is subsequently fed by pulses.

Downstream of the platen 315 are disposed an exhaust upper roller 316 and an exhaust lower roller 317 to carry the sheet P therebetween which is fed on the platen 315. The exhaust upper roller 316 is pressed via a pressure plate 325 having a shaft 323 as the fulcrum by a spring 326, and thereby rotated as a follower along with the rotation of the shaft 323. The peripheral speed of the shaft 323 is set at a value several percent higher than that of the conveying lower roller 310, whereby an adequate tension is always applied to the sheet P on the platen 315 so as not to be loosely held.

Upward of the platen 315 is provided a carriage 329 movable along a rail 327 provided in a direction crosswise to the direction of conveying the sheet P, and a recording head 330 as recording means is provided on the carriage 329. Further, a gear 335 is rotatably provided on the same axis as the exhaust upper roller 316, and has a sheet hold down plate 321 secured thereto which can make contact with an upper surface of the platen 315.

Further, the gear 335 is mated with a gear lever 336 rotatably provided. The gear lever 336 has a return spring 323 and a solenoid 340 which are mounted on opposite sides thereof, whereby the sheet hold down plate 331 waits at a position away from the platen 315 (as shown in FIG. 19) under the action of the return spring 339 when the power is not supplied to the solenoid 340, while the sheet hold down plate 331 can be pressed against the platen 315 by the rotation of the gear lever 336 and thus the gear 335, when the power is supplied to the solenoid 340.

In the following, the operation of the sheet hold down plate 331 which is an essential component of the present invention will be described below.

Figure 21:
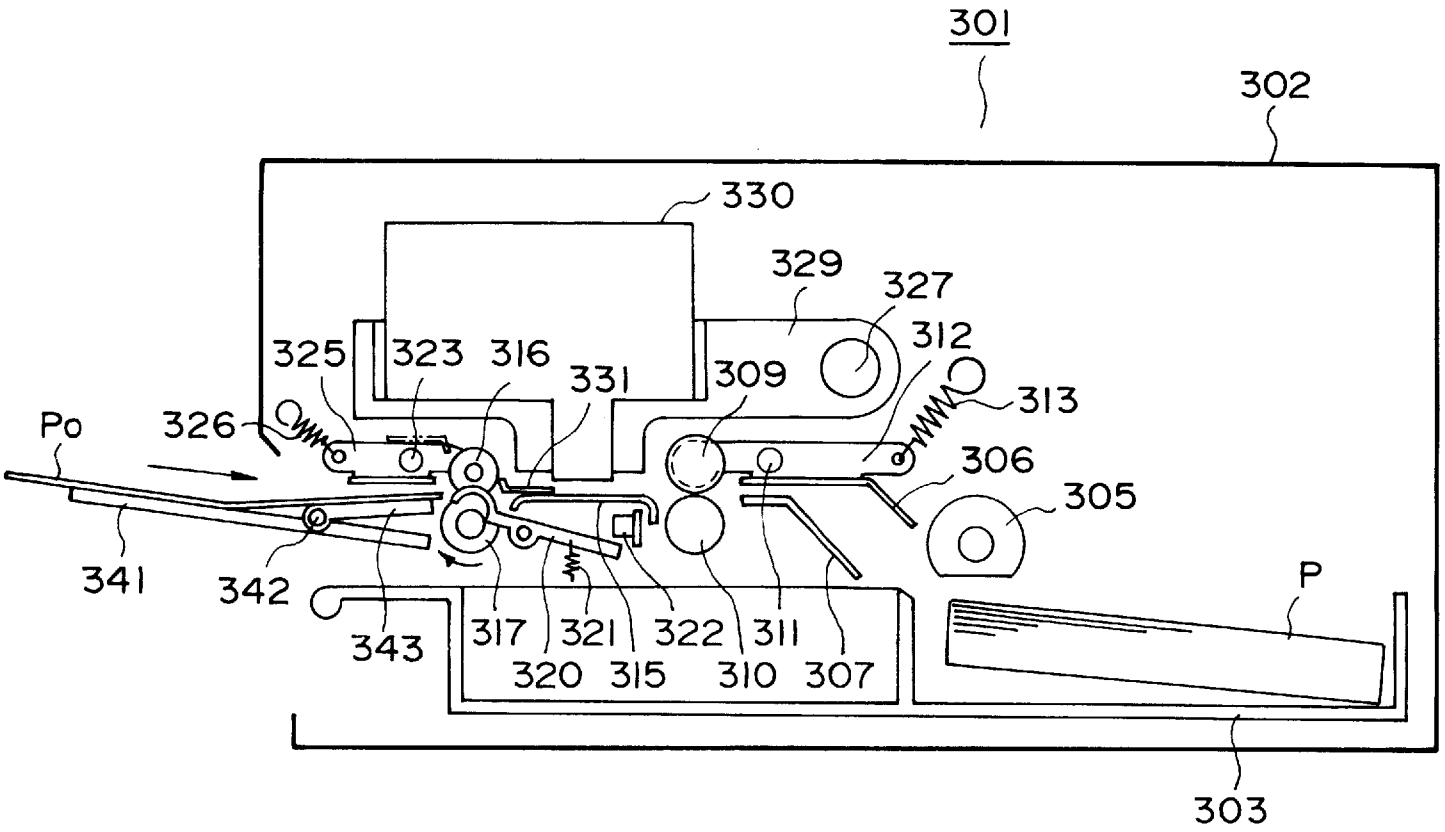
FIG. 21 is a longitudinal side view showing the recording apparatus in a manually inserted state.

In the manual insertion of sheet into this apparatus, upon depressing a button (not shown), a manual insertion tray 343 is raised from a tray 341 as shown in FIG. 21, whereby the apparatus is placed in a standby state. Herein, if a sheet P0 is inserted along the manual insertion tray 343 from the direction of arrow, the sensor arm 320 is pressed down at the instant when a leading end of the sheet P0 enters the nip between a pair of sheet exhaust rollers, so that the pair of sheet exhaust rollers 316, 317 is started to be reversely rotated by a signal of the sensor 322.

After the sheet P0 is drawn into the apparatus by a predetermined amount with the reverse rotation of the pair of sheet exhaust rollers 316, 317, the sheet hold down plate 331 is rotated from a position as indicated by the two-dot chain line to a position as indicated by the solid line under the action of a solenoid 340, whereby the reverse rotation of the pair of sheet exhaust rollers 316, 317 is continued while the sheet P0 is pressed. When a trailing end of sheet exits from the nip between the pair of sheet exhaust rollers 316, 317, the sensor arm 320 returns to an original position with a force of spring 321, which is detected by the sensor 322, so that the driving is stopped at a predetermined timing. Herein, the carriage 329 scans to print the first line with the head 330, and thereafter, the pair of conveying rollers 309, 310 and the pair of sheet exhaust rollers 316, 317 are positively rotated stepwise to perform the printing sequentially.

Figure 22:
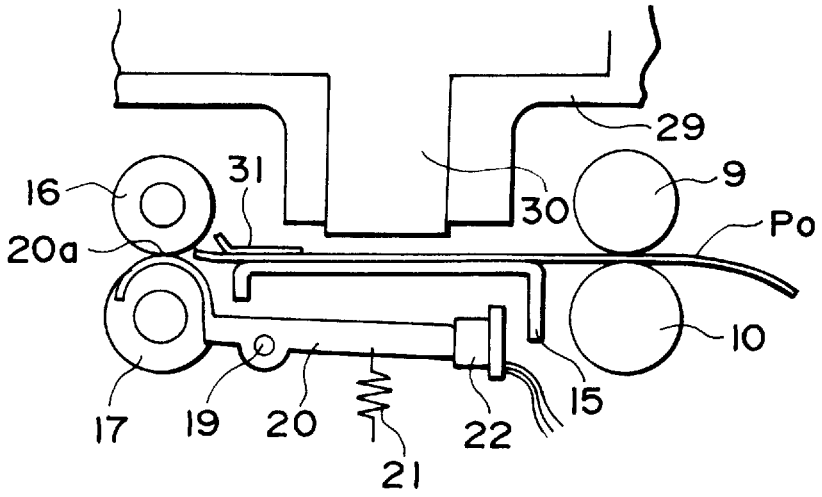
FIG. 22 is an operation view showing the state when a leading edge of sheet exits from the nip.

Though the margin provided at the sheet trailing portion (leading portion in printing) varies depending on the detection precision of the sensor 322, in this embodiment, the sheet P0 is supported near the nip by the sheet hold down plate 331 when the trailing end of sheet exits from the nip between the pair of sheet exhaust rollers 316, 317 as shown in FIG. 22, whereby the trailing end of sheet can be detected stably without being affected by the curl. Thereby, the dispersion of the margin can be suppressed, and it is possible to prevent the print from being made on the platen 315 due to a great deviation of detection timing.

Figure 24:
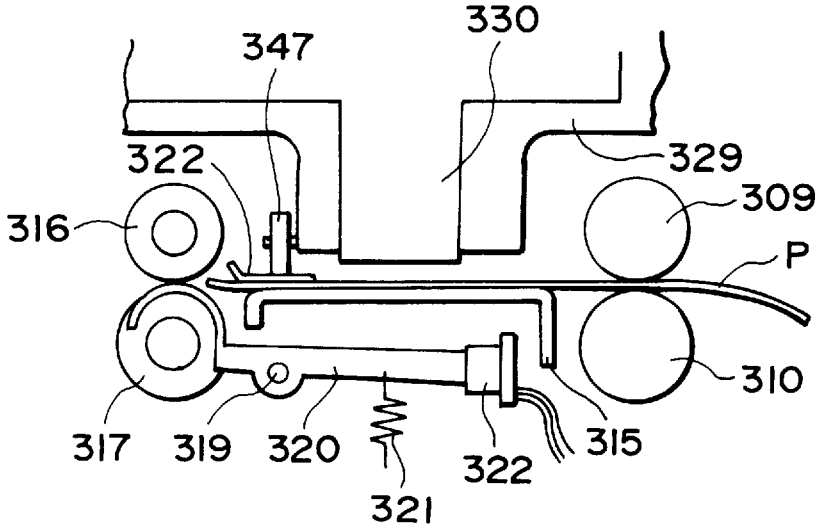
FIG. 24 is an operation view showing the state when a leading edge of sheet exits from the nip.
Figure 23:
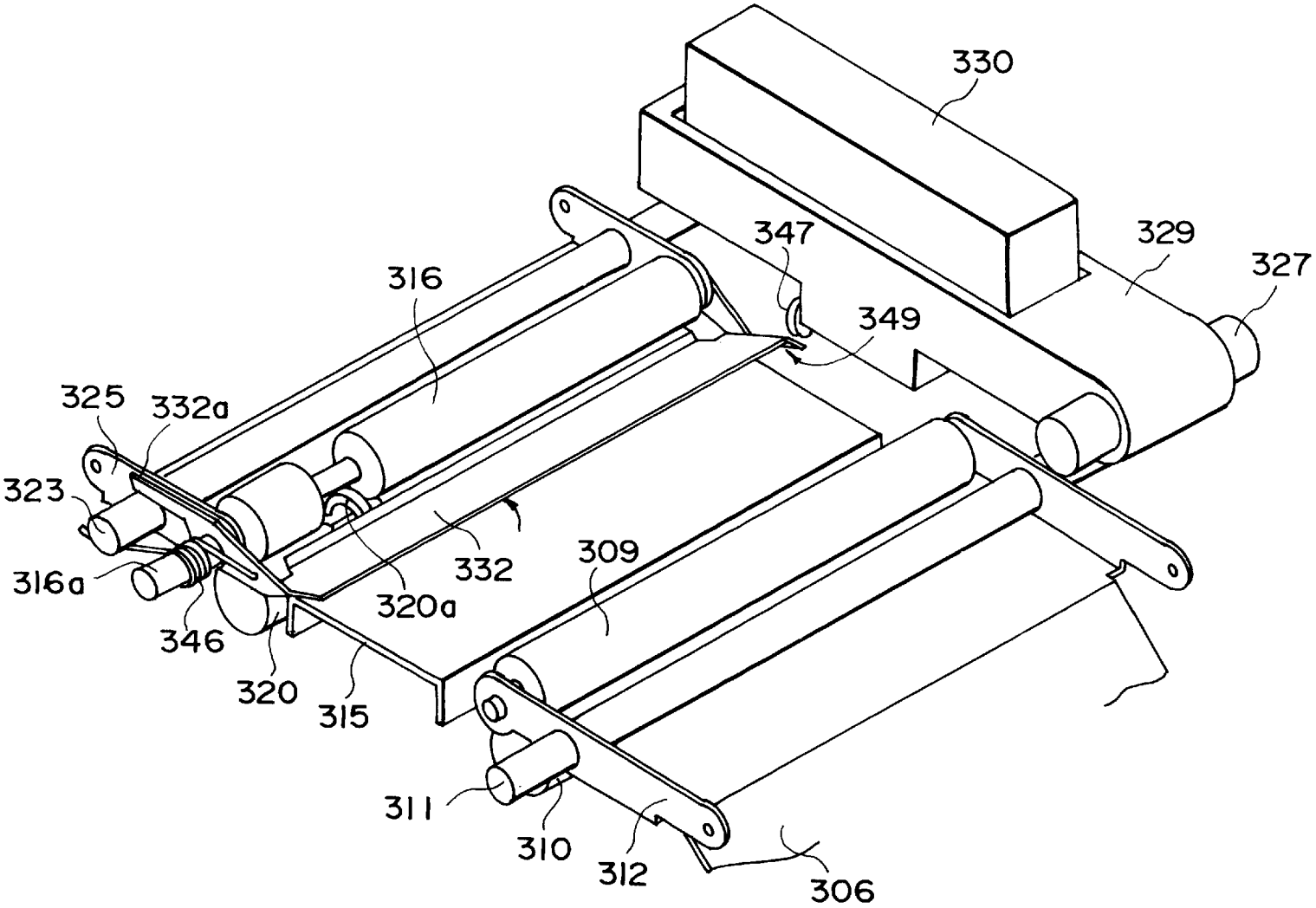
FIG. 23 is a perspective view of a recording apparatus according to a second embodiment of this invention.
Figure 25:
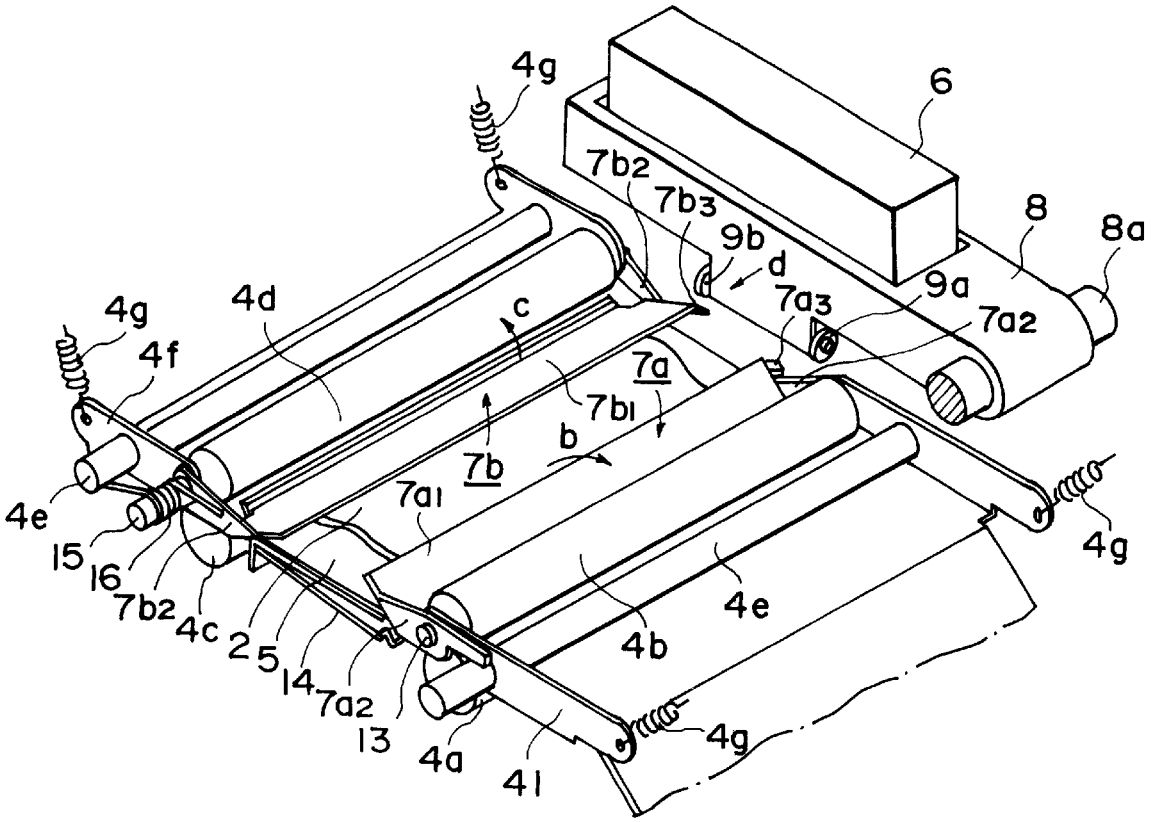
FIG. 25 is a view showing a conventional example.
Figure 26:
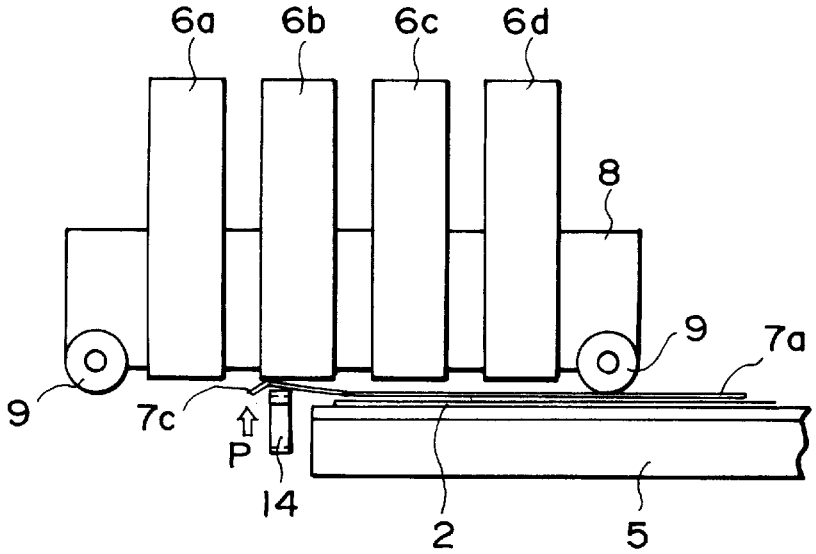
FIG. 26 is a view showing a conventional example.
Figure 27:
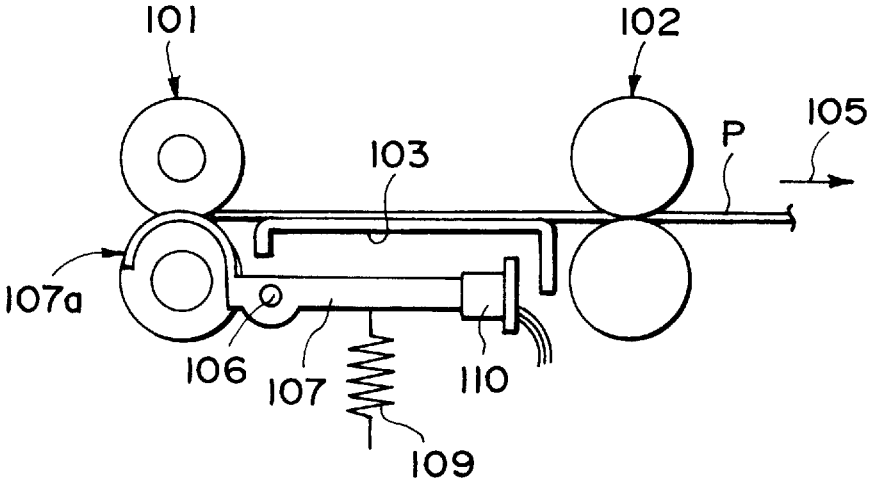
FIG. 27 is a longitudinal side view showing a conventional recording apparatus, in essential parts thereof.
Figure 28:
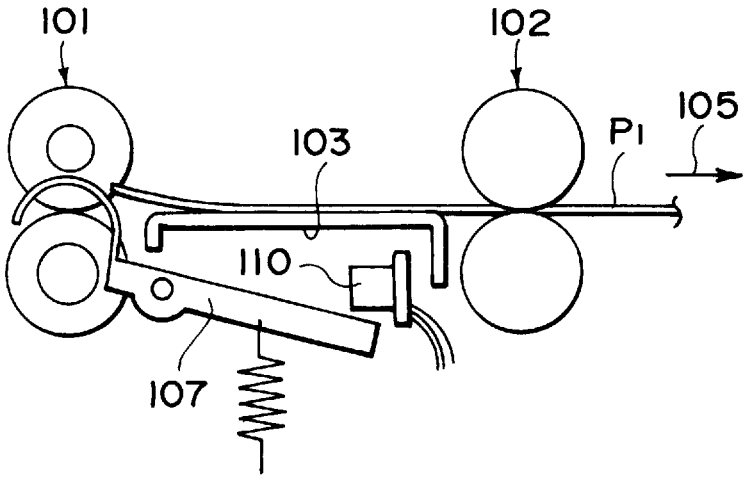
FIG. 28 is an operation view of the same.

FIGS. 23 and 24 show another embodiment of the present invention, wherein the constitution of sheet hold down plate 332 is only different from that of previous embodiments, and therefore that part will be described in detail.

A shaft 316*a* is provided coaxially with a sheet exhaust roller 316, and has a sheet hold down plate 332 supported rotatably. Also, a torsion coil spring 46 is attached to bias the sheet hold down plate 332, and held at a position where a stopper portion 332*a* abuts against a shaft 323. On the other hand, on the carriage 329 is provided a roller 347 as means to press the sheet hold down plate 332 against the platen 315 by riding on an upper face of the sheet hold down plate 332 when the sheet P is moved on to the platen 315, whereby the sheet hold down plate 332 is rotated by the movement of the carriage 329.

As shown in FIG. 21, in the manual insertion mode, if a leading end of sheet P0 presses on the sensor arm 320, the reverse rotation for a pair of sheet exhaust rollers 316, 317 is started, and when the sheet P0 is drawn into the apparatus by a predetermined amount, the carriage 319 is moved as shown FIG. 23, so as to press an end portion of the sheet hold down plate 332 via a roller 347 against the platen 315, whereby the reverse rotation of the pair of sheet exhaust rollers 316, 317 is continued in this state. When the sheet P0 exits from the nip between the pair of sheet exhaust rollers 316, 317, the detection for the trailing end of sheet P0 can be made stably even if there is any curl in the sheet P0, because the sheet hold down plate 332 presses the sheet P0 near the nip, as shown in FIG. 24. Also, this embodiment is effective in the cost and space, because the solenoid 340 is unnecessary as opposed to the previous embodiments.

Though the sheet hold down plates 331, 328 in the above embodiments have the feature of stabilizing the detection of sheet trailing end with the sensor arm 320, it should be noted that they also have the feature of sheet hold down plate such as (i) retaining the distance between nozzle and sheet; and (ii) preventing sheet from floating when printing the leading end, as described in Japanese Patent Appln. Laid-Open No. 2-223268 by the applicant of this invention.

What is claimed is:

1. A sheet conveying apparatus, comprising:

sheet supply means for supplying a sheet from a sheet bundle;

guide means for guiding the sheet supplied by said sheet supply means;

a convey roller for conveying the sheet supplied to said guide means;

a press member assuming a press position for applying pressure to the sheet against said guide means;

release means for releasing the pressure by bringing said press member to a non-press position retracted from the press position when the sheet is supplying, said release means including a rockable release lever contactable with said press member; and a clutch member for controlling operation of said sheet supply means, said clutch member being engageable with the release lever, wherein when said release lever disengages from said clutch member to supply the sheet by said sheet supply means, another portion of the release lever contacts with said press member to bring it to the non-press position.

2. The sheet conveying apparatus according to claim 1, wherein said press member presses the sheet under gravity.

3. The sheet conveying apparatus according to claim 1, wherein said clutch member is intermittently operated upon action of said release means.

4. The sheet conveying apparatus according to claim 3, wherein said clutch member is a spring clutch having a control member selectively engaging said press member upon action of said release means.

5. The recording apparatus according to claim 1, wherein said recording means has an ink jet head for discharging ink.

6. The sheet conveying apparatus according to claim 5, wherein that said ink jet head records an image using the ink discharged with heat energy.

7. A recording apparatus including recording means for recording onto a recording sheet, comprising:

sheet supply means for supplying a sheet;

guide means having a planar surface for guiding the sheet to the recording means;

a press member having a planar surface opposing the planar surface of said guide means at one portion thereof for pressing the sheet against the planar surface of said guide means; and support means for supporting said press member so that the planar surface thereof shifts between a pressing position in proximity to the planar surface of said guide means, and a non-pressing position remote from the planar surface thereof, wherein a shaft is provided on one of another portion of said press member and said support means, and a hole loosely receiving the shaft is provided on the other of them to thereby allow shift of said press member between the pressing and non-pressing positions.

8. The recording apparatus according to claim 7, further comprising a hold down member for bringing said press member into close contact with recording sheet.

9. The recording apparatus according to claim 7, wherein said recording means is an ink jet recording means for recording by discharging ink.

10. The recording apparatus according to claim 9, wherein said recording means has electricity-heat converters for generating heat energy for use in discharging the ink.

11. The recording apparatus according to claim 10, wherein said recording means discharges the ink through discharge orifices by heating the ink to cause film boiling in the ink using the heat energy generated by said electricity-heat converters.

* * * * *

UNITED STATES PATENT AND TRADEMARK OFFICE

CERTIFICATE OF CORRECTION

PATENT NO. : 5,808,647

DATED : September 15, 1998

INVENTOR(S) : MITSURU KURATA, ET AL.

It is certified that error appears in the above-identified patent and that said Letters Patent is hereby corrected as shown below:

COLUMN 1,
Line 35, "to obstruct" should read --obstruction of--.

COLUMN 5,
Line 62, "coo led," should read --cooled,--.

COLUMN 16,
Line 64, "determines" should read --determine--.

COLUMN 19,
Line 5, "claim 1," should read -- claim 7 --; and
Line 8, "that said" should read -- said --.

UNITED STATES PATENT AND TRADEMARK OFFICE

CERTIFICATE OF CORRECTION

PATENT NO. : 5,808,647

DATED : September 15, 1998

INVENTOR(S) : MITSURU KURATA, ET AL.

It is certified that error appears in the above-identified patent and that said Letters Patent is hereby corrected as shown below:

On the title page, Item [75], Inventors:, "Mitsuru Kurata, Kawasaki; Shigeyoshi Onoda, Yokohama, both of Japan" should read --Mitsuru Kurata, Kawasaki; Shigeyoshi Onoda, Yokohama; Yasuo Miyauchi, Kawasaki; all of Japan--.

Signed and Sealed this

Eleventh Day of May, 1999

*Attest:*

*Attesting Officer*

Q. TODD DICKINSON

*Acting Commissioner of Patents and Trademarks*